US009858905B2

(12) United States Patent
Tanabe

(10) Patent No.: US 9,858,905 B2
(45) Date of Patent: Jan. 2, 2018

(54) MOUNTING DEVICE FOR CYMBAL TYPE PERCUSSION INSTRUMENT

(71) Applicant: YAMAHA CORPORATION, Hamamatsu-shi, Shizuoka (JP)

(72) Inventor: Emi Tanabe, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/001,869

(22) Filed: Jan. 20, 2016

(65) Prior Publication Data

US 2016/0210945 A1 Jul. 21, 2016

(30) Foreign Application Priority Data

Jan. 21, 2015 (JP) ..... 2015-009526
Jul. 27, 2015 (JP) ..... 2015-147551

(51) Int. Cl.
*G10D 13/02* (2006.01)
*G10D 13/06* (2006.01)

(52) U.S. Cl.
CPC ..... *G10D 13/06* (2013.01)

(58) Field of Classification Search
USPC ..... 84/402
See application file for complete search history.

(56) References Cited

U.S. PATENT DOCUMENTS 4,037,509 A * 7/1977 Slomovits ..... G10D 13/06 84/422.3
5,959,227 A * 9/1999 Shapiro ..... G10D 13/06 84/411 M
5,969,281 A * 10/1999 Suenaga ..... G10G 5/00 84/421
9,099,072 B2 * 8/2015 Yoshino ..... G10D 13/06
2014/0083276 A1 3/2014 Yoshino
2015/0269921 A1 * 9/2015 Truchsess ..... G10D 13/06 84/422.1

FOREIGN PATENT DOCUMENTS

JP 08272359 A 10/1996
JP 11184459 A 7/1999
JP 5224918 7/2013
JP 2014066832 A 4/2014

OTHER PUBLICATIONS

Ikebe New Product Press. The Next Generation of "Noise Dampers" Cymbals from Zildjian, GEN16 Buffed Bronze appeared! pp. 1-8. URL:http://www.ikebe-gakki-pb.com/new_product/?p=3286. Retrieved on Jun. 19, 2015. Partial English translation provided.

* cited by examiner

*Primary Examiner* — Christopher Uhlir
(74) *Attorney, Agent, or Firm* — Rossi, Kimms & McDowell LLP

(57) ABSTRACT

A mounting device for a cymbal type percussion instrument, the cymbal type percussion instrument which includes at least one cymbal that is supported on a support, the mounting device includes: a mounting member which is mounted in at least two different positions on the cymbal type percussion instrument, the mounting member which is configured to suppress motion of the cymbal when the mounting member is mounted in the at least two different positions on the cymbal type percussion instrument so as to hold a position of the mounting member relative to the cymbal.

13 Claims, 16 Drawing Sheets

MOUNTING DEVICE FOR CYMBAL TYPE PERCUSSION INSTRUMENT

CROSS-REFERENCE TO RELATED APPLICATION(S)

This application is based upon and claims the benefit of priority from prior Japanese patent application No. 2015-009526, filed on Jan. 21, 2015 and Japanese patent application No. 2015-147551, filed on Jul. 27, 2015, the entire contents of which are incorporated herein by reference.

BACKGROUND

The present invention relates to a mounting device a cymbal type percussion instrument.

According to the background art, there is a damping device for a cymbal, which can reduce hitting sound occurring when an acoustic cymbal made of metal is hit. For example, in the following Patent Literatures 1 through 3, there has been used a configuration in which a damping piece is mounted on a cymbal. That is, in the following Patent Literature 1, an elastic sheet is attached to a cymbal in a region ranging from an upper surface of the cymbal to an edge of the cymbal and the portion of the elastic sheet is hit during performance so that hitting sound can be reduced. In the following Patent Literature 2, a ring-like silencing piece which can expand and compress is attached to the whole of a circumferential edge portion of a cymbal so that sound can be silenced. In the following Patent Literature 3, a frame is attached to a back side of a cymbal to press an elastic member against a bow portion so that hitting sound can be reduced. In addition thereto, a performer may paste tape to the cymbal or hold the circumferential edge portion with a clip etc.

On the other hand, in the following Patent Literature 4, there has been used a configuration in which a large number of small holes are formed in a metal plate constituting a cymbal to absorb hitting energy so that sound can be silenced.

The following configuration has been used in the following non-Patent Literature 1. That is, a large number of small holes are formed in a metal plate constituting the cymbal to absorb hitting energy so that sound can be silenced. In addition, a sensor for detecting hitting is provided in the cymbal so that it is possible to add electronic music.

In the background art, no special difference will appear in an acoustic cymbal even if the cymbal is hit at any circumferential position. Accordingly, the cymbal is normally not restricted from rotating relatively to a stand.

[Patent Literature 1] JP-UM-A-52-24918

[Patent Literature 2] JP-A-8-272359

[Patent Literature 3] JP-A-2014-66832

[Patent Literature 4] JP-A-11-184459

[Non-Patent Literature] "Ikebe New Product Press", [online], The next generation of "noise dampers" cymbals from Zildjian, GEN16 BUFFED BRONZE appeared!, (Retrieved on Jun. 19, 2015), Internet <URL:http://www.ikebe-gakki-pb.com/new_product/?p=3286>

However, as disclosed in Patent Literatures 1 through 3, when an excessively soft foreign body is placed as the damping piece on the cymbal in the configuration in which the damping piece is mounted on the cymbal, feeling of hitting largely differs from that of an ordinary acoustic cymbal. In addition, bouncing back after hitting becomes so weak that it is difficult to make a roll. Further, the degree of surface friction changes so that it is difficult to use a technique of performing sliding on the surface of the cymbal.

In addition, in the configuration in which the entire region of the damping piece facing a bow portion of the cymbal touches the bow portion, vibration of the bow portion is suppressed in a wide area. Accordingly, hitting sound changes largely from original sound of the cymbal. Particularly when a soft damping piece is placed on the cymbal, sound rich in a high frequency is attenuated excessively. Hitting sound turns to sound mainly containing low-frequency components as if rubber or sponge were hit. Further, when the cymbal has a configuration in which the cymbal is largely covered with the damping piece from above, external appearance of the cymbal changes largely.

In addition, in the configuration disclosed in Patent Literature 4, unique shape characteristics as the small holes have to be provided in the cymbal per se. For the reason, the cymbal cannot be used widely. In addition, also in any of the configurations according to the background art, the degree of damping cannot be adjusted easily by a performer.

According to the cymbal disclosed in non-Patent Literature 1, when the cymbal rotates, the hitting position changes. Therefore, there is a fear that detection accuracy may be unstable due to the relation between the hitting position and the sensor position as described above. It may be considered that the small holes formed in the cymbal are used so that rotation of the cymbal can be restricted by some member. However, such a small hole is absent from a widely used acoustic cymbal. It is therefore unrealistic to perform additional treatment etc. on the cymbal to form a lock portion such as a small hole in the cymbal for restricting rotation of the cymbal.

In the case in which at least apart of the mounting member such as the damping piece is exposed on an upper side of the cymbal, it is necessary to hit the cymbal while keeping away from the mounting member. Thus, in some arrangement of the mounting member, when the cymbal rotates, the position of the mounting member may change to make it difficult to perform the cymbal.

SUMMARY

It is an object of the invention to provide a mounting device for a cymbal type percussion instrument, which can reduce volume without excessively affecting hitting sound and in which a rotation range of an acoustic cymbal can be restricted without applying special treatment to the acoustic cymbal.

In order to achieve the object, according to the invention, there is provided a mounting device for a cymbal type percussion instrument, the cymbal type percussion instrument including at least one cymbal supported on a support, the mounting device comprising: a mounting member which is mounted in at least two different positions on the cymbal type percussion instrument, the mounting member which is configured to suppress motion of the cymbal when the mounting member is mounted in the at least two different positions on the cymbal type percussion instrument so as to hold a position of the mounting member relative to the cymbal.

The cymbal may include a cup portion and a bow portion, an insertion hole formed in the cup portion, a rod which is a part of the support inserted into the insertion hole to support the cup portion on the support, the bow portion coupled to the cup portion and having an edge portion as an outer circumferential edge, and the mounting member may include a connection portion which connects a first engagement portion and a second engagement portion to each other, the first engagement portion being one of the insertion hole, the support and a portion fixed to the support, the second engagement portion being one of the edge portion of the bow portion and an engagement function portion provided in a position closer to the edge portion than the cup portion in the bow portion.

There is also provided a damping device which is the mounting device, and which is configured to reduce hitting sound of the cymbal by suppressing vibrating motion of the cymbal when the cymbal is hit, wherein when the first engagement portion and the second engagement portion are connected to each other, the connection portion urges the first engagement portion and the second engagement portion in a direction to approach each other, and at least a part of the connection portion, which faces the bow portion, is brought into a non-abutment state with the bow portion.

The first engagement portion may include an upper engagement portion which can be engaged from an upper side of the cup portion and a lower engagement portion which can be engaged from a lower side of the cup portion, the second engagement portion may be the edge portion, and one end portion of the connection portion may be engaged with the lower engagement portion from the lower side of the cup portion, while the connection portion may be put around the edge portion to engage the other end portion of the connection portion with the upper engagement portion from the upper side of the cup portion, so that a portion of the edge portion around which the connection portion is put is urged in a direction toward a position of the insertion hole.

There is also provided a damping device which is the mounting device, and which is configured to reduce hitting sound of the cymbal, wherein the connection portion brings each of engagement portions into a connection relation to at least one of the other engagement portions, the engagement portions including an arbitrary circumferential place of the edge portion and an engagement function portion provided in a position closer to the edge portion than the cup portion, and when the connection portion brings each of engagement portions into the connection relation with the at least one of the other engagement portions, the connection portion urges the engagement portions in the connection relation in a direction to approach each other, and at least a part of the connection portion, which faces the bow portion, is brought into a non-abutment state with the bow portion.

The connection portion may be constituted by an elastic member and exerts an urging force due to its elasticity.

The connection portion may include an adjustment mechanism which adjusts a length of the connection portion.

There is also provided a cymbal type percussion instrument which includes the mounting device, the cymbal which is an acoustic cymbal which is hit to make vibration to thereby produce sound as performance sound, the cymbal type percussion instrument comprising: a sensor which is attached to the acoustic cymbal and which is configured to detect the vibration of the acoustic cymbal; a fixation portion which is fixed to the support; and a restriction portion which is a part of the fixation portion or fixed to the fixation portion, and which is engaged with the mounting member mounted on the acoustic cymbal to thereby restrict the acoustic cymbal from rotating, wherein the mounting device is configured to suppress rotating motion of the acoustic cymbal when the acoustic cymbal is hit.

The mounting member may be a damping member which is configured to reduce hitting sound of the acoustic cymbal.

There is also provided a cymbal type percussion instrument which includes the mounding device, wherein the cymbal is an acoustic cymbal, the mounting member is a damping member which is mounted on the acoustic cymbal so that at least a part of the damping member is exposed on an upper side from the acoustic cymbal and which is configured to reduce hitting sound of the acoustic cymbal, the cymbal type percussion instrument includes a fixation portion which is fixed to the support, and a restriction portion which is a part of the fixation portion or fixed to the fixation portion and which is engaged with the damping member mounted on the acoustic cymbal to thereby restrict the acoustic cymbal from rotating, and when the connection portion connects the first engagement portion and the second engagement portion to each other, the connection portion urges the first engagement portion and the second engagement portion in a direction to approach each other, and at least a part of the connection portion, which faces the bow portion, is brought into a non-abutment state with the bow portion.

The first engagement portion may include an upper engagement portion which can be engaged from an upper side of the cup portion and a lower engagement portion which can be engaged from a lower side of the cup portion, the second engagement portion may be the edge portion, and one end portion of the connection portion may be engaged with the lower engagement portion from the lower side of the cup portion, while the connection portion may be put around the edge portion to engage the other end portion of the connection portion with the upper engagement portion from the upper side of the cup portion, so that a portion of the edge portion around which the connection portion is put is urged in a direction toward a position of the insertion hole.

There is also provided a cymbal type percussion instrument which includes the mounding device, wherein the cymbal is an acoustic cymbal, the mounting member is a damping member which is mounted on the acoustic cymbal so that at least a part of the damping member is exposed on an upper side from the acoustic cymbal and which is configured to reduce hitting sound of the acoustic cymbal, the cymbal type percussion instrument includes a fixation portion which is fixed to the support, and a restriction portion which is a part of the fixation portion or fixed to the fixation portion and which is engaged with the damping member mounted on the acoustic cymbal to thereby restrict the acoustic cymbal from rotating, the connection portion brings each of engagement portions into a connection relation with at least one of the other engagement portions, the engagement portions including an arbitrary circumferential place of the edge portion and an engagement function portion provided in a position closer to the edge portion than the cup portion, and when the connection portion brings each of engagement portions into the connection relation with the at least one of the other engagement portions, the connection portion urges the engagement portions in the connection relation in a direction to approach each other, and at least a part of the connection portion, which faces the bow portion, is brought into a non-abutment state with the bow portion.

The cymbal type percussion instrument may further comprise: a sensor which is attached to the acoustic cymbal and which is configured to detect vibration of the acoustic cymbal.

There is also provided a cymbal rotation restricting device which is the mounting device, the cymbal which is an acoustic cymbal, the cymbal rotation restricting device comprising: a restriction portion which is a part of a fixation portion fixed to the support or fixed to the fixation portion, and which is engaged with the mounting member mounted on the acoustic cymbal to thereby restrict the acoustic cymbal from rotating.

DETAILED DESCRIPTION OF EXEMPLARY EMBODIMENTS

A cymbal makes complicated and large motion by a hitting operation or a pedal opening/closing operation of a performer. The motion includes, for example, vibration in a circumferential direction of the cymbal, vibration from an end of the cymbal which is hit to an opposite end of the cymbal, rotation about a central axis of the cymbal, or swing about the central axis of the cymbal. Due to the motion of the cymbal, sound is generated. In the invention, the motion of the cymbal which is made when hitting can be suppressed. In some embodiments, by suppressing the vibration of the cymbal, volume of the generated sound can be reduced without affecting the sound. In the other embodiments, by suppressing the rotation of the cymbal, detection accuracy of hitting can be increased.

Embodiments of the invention will be described below with reference to the drawings.

First Embodiment

Figure 1A:
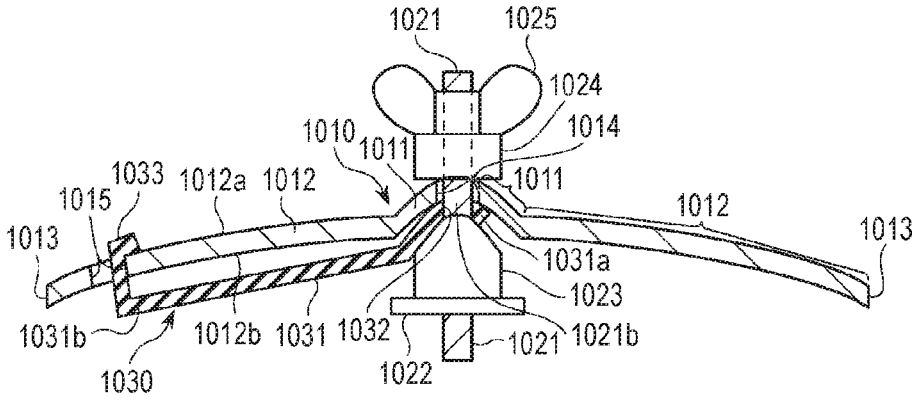
FIG. 1A is a schematic sectional view of a cymbal to which a damping device according to a first embodiment is applied.
Figure 1B:
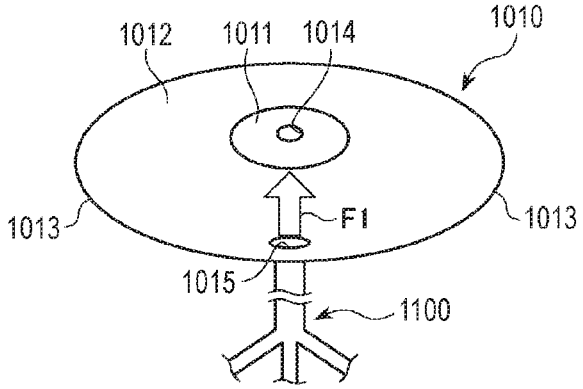
FIG. 1B is a schematic perspective view of the cymbal which is seen obliquely from top.

FIG. 1A is a schematic sectional view of a cymbal to which a damping device according to a first embodiment of the present invention is applied. FIG. 1B is a schematic perspective view of the cymbal which is seen obliquely from top (front). The cymbal 1010 is an acoustic percussion instrument which is mainly made of metal and which is hit and performed by a performer. The cymbal 1010 has a cup portion 1011, and a bow portion 1012 which is coupled to the cup portion 1011. The cup portion 1011 and the bow portion 1012 are formed integrally into a disk shape. The cup portion 1011 bulges slightly upward in a bowl shape from the bow portion 1012. An insertion hole 1014 is formed in the center of the cup portion 1011. An outer circumferential edge of the bow portion 1012 serves as an edge portion 1013. When being placed horizontally, the bow portion 1012 is curved gently so as to be inclined downward as it goes toward an outer side in a radial direction. The bow portion 1012 has a front face 1012*a* and a back face 1012*b*. The front face 1012*a* becomes a face which is mainly hit. In addition thereto, the edge portion 1013 or the cup portion 1011 can be also a subject to be hit.

The cymbal 1010 is supported by a stand 1100 (FIG. 1B) serving as a support having a rod 1021. First, the cup portion 1011 and a connection portion 1031 of a damping piece 1030 are interposed between an upper buffer material 1024 and a lower buffer material 1023. The lower buffer material 1023 is disposed on a pedestal 1022. The rod 1021 is inserted into the insertion hole 1014 of the cup portion 1011 from below and fastened by a clamp 1025 through the buffer material 1024. The clamp 1025 serves as a wing nut. Thus, the cymbal 1010 is supported on the rod 1021. The rod 1021 is fitted to the insertion hole 1014 loosely. The cymbal 1010 can swing and rotate with respect to the rod 1021 to some degree. Incidentally, the buffer material 1023 may be shaped like a cylinder.

Figure 1C:
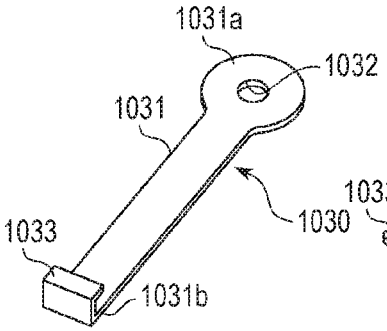
FIGS. 1C to 1E are perspective views of damping pieces.

As the damping device for reducing hitting sound of the cymbal 1010, the damping piece 1030 is mounted on the cymbal 1010. FIG. 1C is a perspective view of the damping piece 1030. In FIG. 1A, the damping piece 1030 is drawn to be thick in thickness with exaggeration. The damping piece 1030 has the connection portion 1031 which is formed integrally as an elastic member such as rubber, an electric resin or a spring. Incidentally, any other portion than the connection portion 1031 in the damping piece 1030 may be constituted by a harder member than the connection portion 1031. An attachment hole 1032 is formed in one end portion 1031*a* of the connection portion 1031 in a longitudinal direction, and a hook-like attachment portion 1033 is formed in the other end portion 1031*b* of the connection portion 1031. The attachment hole 1032 has a size large enough to be penetrated by the rod 1021.

An engagement hole 1015 is formed in the bow portion 1012 (FIGS. 1A and 1B). The engagement hole 1015 is an engagement function portion which is provided in a position closer to the edge portion 1013 than the cup portion 1011 in the radial direction. In the embodiment, the engagement hole 1015 is an example of a "second engagement portion".

The damping piece 1030 connects a portion 1021*b* of the rod 1021 and the engagement hole 1015 to each other. The portion 1021*b* is interposed between the cup portion 1011 and the buffer material 1023. In the embodiment, particularly the portion 1021*b* of the rod 1021 is an example of a "first engagement portion". That is, in order to support the cymbal 1010 on the rod 1021, the rod 1021 is inserted into the attachment hole 1032 of the damping piece 1030 so that the one end portion 1031*a* of the damping piece 1030 can be interposed between the cup portion 1011 and the buffer material 1023, and the cup portion 1011 and the one end portion 1031*a* of the damping piece 1030 are fastened by the clamp 1025 through the buffer material 1024. Further, the attachment portion 1033 of the other end portion 1031*b* of the damping piece 1030 is inserted into the engagement hole 1015 from below so as to be engaged therewith.

A length of the connection portion 1031 (a length between the attachment hole 1032 and the attachment portion 1033) in a free state is set to be slightly shorter than a distance between the portion 1021*b* and the engagement hole 1015. Accordingly, when the attachment hole 1032 is engaged with the portion 1021*b* and the attachment portion 1033 is engaged with the engagement hole 1015, the connection portion 1031 is brought into a tensile state. Due to elasticity of the connection portion 1031, the connection portion 1031 urges the portion 1021*b* and the engagement hole 1015 in a direction to approach each other. The portion 1021*b* is one part of the rod 1021 fixed to the stand 1100. Accordingly, an urging force F1 toward the radial center of the cymbal 1010 where the insertion hole 1014 is located acts on the engagement hole 1015 relatively (FIG. 1B). As a result, as the cymbal 1010, the insertion hole 1014 and the engagement hole 1015 are urged in a direction to approach each other.

The connection portion 1031 is in a non-abutment state with the bow portion 1012 in at least a part of a region facing the back face 1012*b* of the bow portion 1012. In the example of FIG. 1A, the bow portion 1012 is curved to be convex upward. Accordingly, the connection portion 1031 is in a non-abutment state with the bow portion 1012 in almost the entire region.

Figure 2:
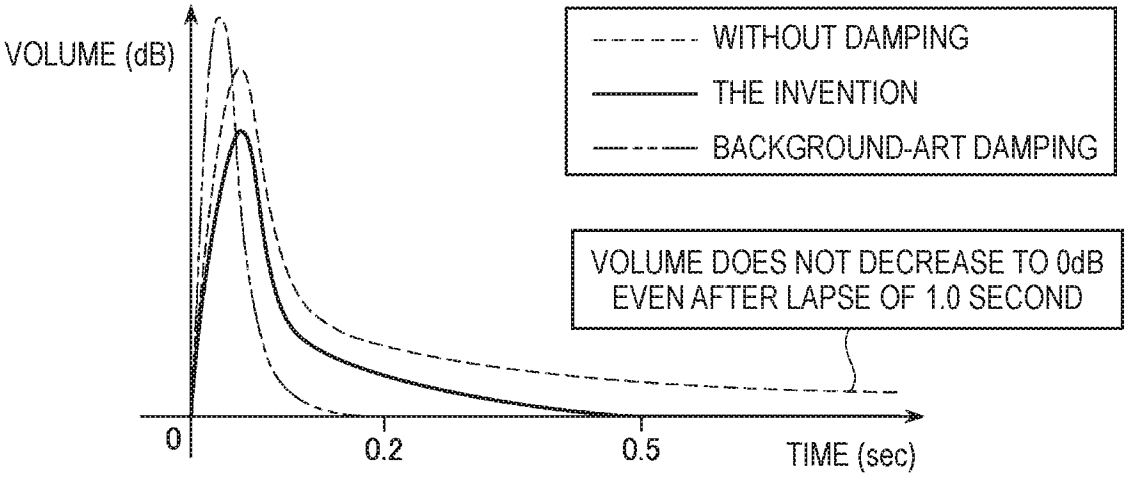
FIG. 2 is a graph showing temporal change in volume of hitting sound due to mounting with/without a damping piece.

FIG. 2 is a view showing temporal change in volume of hitting sound due to mounting with/without a damping piece. In FIG. 2, the abscissa designates elapsed time (second) after hitting, and the ordinate designates volume (dB). When no damping piece is mounted, the volume does not decrease to 0 dB even after a lapse of about 1.0 second. On the other hand, when the damping piece according to the background art is mounted to mute sound substantially completely, the sound is completely attenuated before a lapse of about 0.2 seconds. On the contrary, when the damping piece 1030 according to the embodiment is mounted, the volume is attenuated to 0 dB after a lapse of about 0.5 seconds. Pay attention to the maximum level. The maximum level in the case where the damping piece 1030 according to the embodiment is mounted is suppressed to be lower than that in any of the case where no damping piece is mounted and the case where the damping piece according to the background art is mounted. That is, it is possible to suppress the volume to be lower while keeping a moderate attenuation time of sound.

According to analysis of the present applicant, it has been proved that such an effect can be obtained when the insertion hole 1014 and the engagement hole 1015 are urged in a direction to approach each other in the cymbal 1010. In the embodiment which is different from the background-art configuration in which a soft damping piece is mounted on the cymbal, tension in a compression direction is applied to apart of the cymbal 1010 so that volume can be suppressed to be lower without excessively attenuating sound rich in a high frequency.

In addition, the connection portion 1031 of the damping piece 1030 has a region which belongs to the region facing the bow portion 1012 and which is in a non-abutment state with the bow portion 1012. Accordingly, vibration of the bow portion can be prevented from being suppressed in a wide area as in a configuration in which the connection portion 1031 touches the bow portion in the entire region as described in the background art. Thus, hitting sound can be prevented from changing largely from original cymbal sound.

Accordingly, according to the embodiment, it is possible to reduce the volume without excessively affecting the hitting sound.

In addition, in the damping piece 1030, the portion which is exposed on the front side of the cymbal 1010 is only the attachment portion 1033. Accordingly, it is possible to secure a large region where the damping piece 1030 does not have to be hit directly, i.e. a large hitting area where feeling of hitting does not change, in comparison with the background-art configuration in which the cymbal is largely covered with the damping piece from above. Accordingly, it is possible to reduce the possibility that the feeling of hitting may be spoiled. In addition, it is also possible to prevent external appearance of the cymbal 1010 from changing largely. Moreover, the connection portion 1031 of the damping piece 1030 is constituted by an elastic member to exert an urging force due to its elasticity. Accordingly, it is possible to generate an urging force with a simple configuration.

Figure 1D:
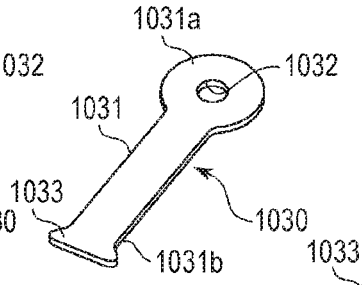
Figure 1E:
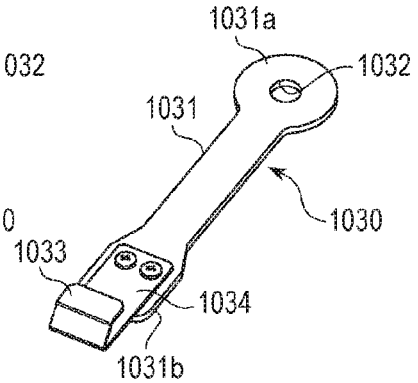

Incidentally, the configuration of the portion attached to the cymbal 1010 in the damping piece 1030 is not limited to the illustrated one. Several modifications will be described later. For example, modifications shown in FIGS. 1D and 1E may be used in the embodiment. That is, the attachment portion 1033 of the damping piece 1030 may be not shaped like a hook but formed into a wide shape (FIG. 1D). The wide attachment portion 1033 which is inserted into the engagement hole 1015 to be engaged therewith can also achieve the same function as that in FIG. 1C. The damping piece 1030 may be not formed integrally but a metal fitting 1034 may be attached to the other end portion 1031*b* and a hook-like attachment portion 1033 may be formed in the metal fitting 1034 alternatively, as shown in FIG. 1E. Incidentally, it may go well as long as at least a part (mainly the connection portion 1031) of the damping piece 1030 has elasticity. Accordingly, configuration may be made in such a manner that a metal fitting etc. where the attachment hole 1032 is formed is also attached to the one end portion 1031*a*.

Incidentally, the number of the engagement holes 1015 formed in the cymbal 1010 is not necessarily one, but one of the small holes used in the aforementioned Patent Literature 4 may be used.

Second Embodiment

Figure 3A:
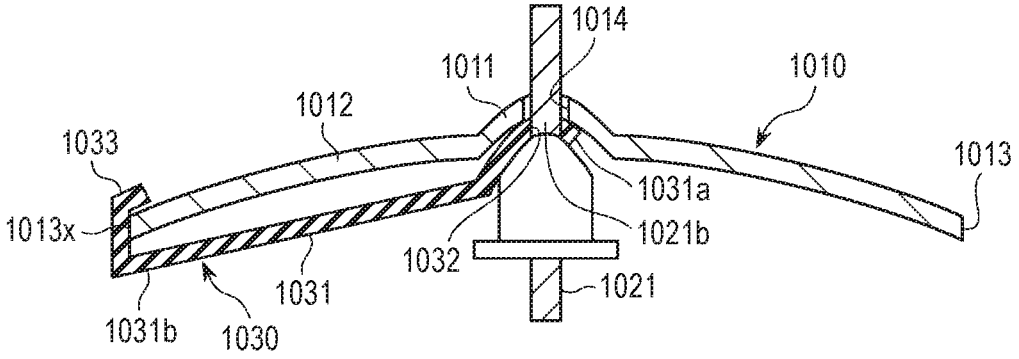
FIG. 3A is a schematic sectional view of a cymbal to which a damping piece according to a second embodiment is applied and FIG. 3B is a schematic perspective view of the cymbal which is seen obliquely from top.
Figure 3B:
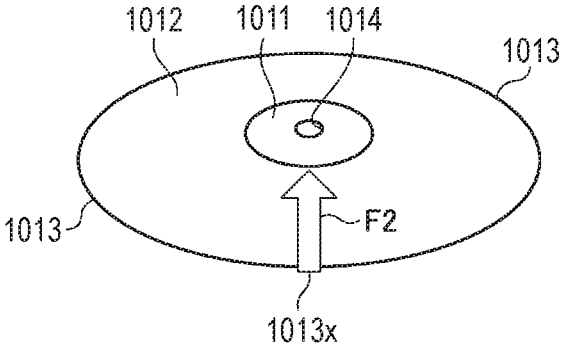

FIG. 3A is a schematic sectional view of a cymbal to which a damping piece according to a second embodiment is applied. FIG. 3B is a schematic perspective view of the cymbal which is seen obliquely from top. A buffer material 1024, a clamp 1025, etc. are not shown in FIGS. 3A and 3B.

The first embodiment has a configuration in which the attachment portion 1033 of the damping piece 1030 is engaged with the engagement hole 1015 formed in the cymbal 1010. In contrast with this, the damping piece 1030 in the second embodiment is connected to an edge portion 1013 which is an outer circumferential edge of a bow portion 1012.

In the embodiment, the damping piece 1030 connects a portion 1021*b* of a rod 1021 and an edge portion 1013*x* to each other. The edge portion 1013*x* is an arbitrary place in a circumferential direction in the edge portion 1013 which is the outer circumferential edge of the bow portion 1012. The position of the edge portion 1013*x* is not limited. In the embodiment, the edge portion 1013*x* is an example of the "second engagement portion". The configuration of the damping piece 1030 is the same as that shown in FIG. 1C. A length of the damping piece 1030 is set to be slightly shorter than a distance between the portion 1021*b* and the edge portion 1013*x*.

As shown in FIG. 3A, the rod 1021 is inserted into an attachment hole 1032 in one end portion 1031*a* of the damping piece 1030. This point is the same as that in the first embodiment. On the other hand, a hook-like attachment portion 1033 in the other end portion 1031*b* of the damping piece 1030 is hooked onto the edge portion 1013*x* from its lower outer circumferential side so as to be engaged therewith. When the attachment hole 1032 is engaged with the portion 1021*b* and the attachment portion 1033 is engaged with the edge portion 1013*x*, the connection portion 1031 is brought into a tensile state. Due to elasticity of the connection portion 1031, the connection portion 1031 urges the portion 1021*b* and the edge portion 1013*x* in a direction to approach each other. As a result, the insertion hole 1014 and the edge portion 1013*x* are urged in the direction to approach each other so that an urging force F2 toward the insertion hole 1014 can act on the edge portion 1013*x* (FIG. 3B). In addition, in the same manner as in the first embodiment, the connection portion 1031 is brought into a non-abutment state with the bow portion 1012 in almost the entire region.

In the cymbal 1010, the insertion hole 1014 and the edge portion 1013*x* are urged in a direction to approach each other. Accordingly, it is possible to obtain an effect that it is possible to suppress the volume to be lower while keeping a moderate attenuation time of sound, as described in FIG. 2.

According to the embodiment, it is possible to obtain the same effect as that in the first embodiment in order to reduce volume without excessively affecting hitting sound. At the same time, the cymbal 1010 does not have to have any engagement hole 1015. Accordingly, versatility of the damping piece 1030 is wide.

Third Embodiment

Figure 4A:
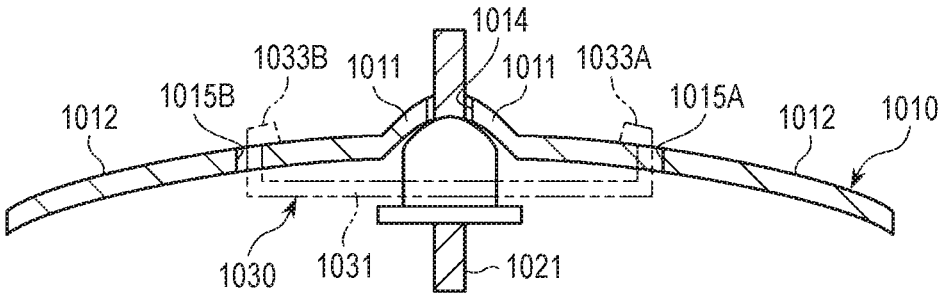
FIG. 4A is a schematic sectional view of a cymbal to which a damping piece according to a third embodiment is applied.
Figure 4B:
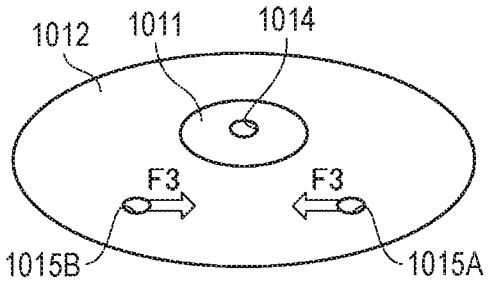
FIG. 4B is a schematic perspective view of the cymbal which is seen obliquely from top.
Figure 4C:
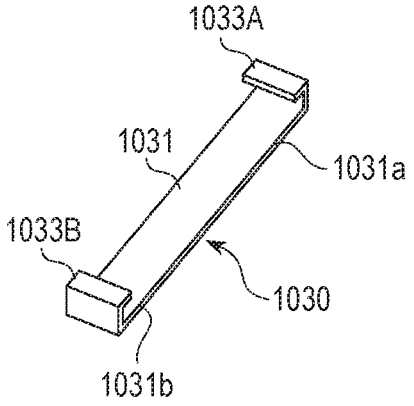
FIGS. 4C and 4D are perspective views of cymbals.

FIG. 4A is a schematic sectional view of a cymbal to which a damping piece according to a third embodiment is applied. FIG. 4B is a schematic perspective view of the cymbal which is seen obliquely from top. FIG. 4C is a perspective view of a damping piece 1030. A buffer material 1024, a clamp 1025, etc. are not shown in FIGS. 4A and 4B.

In the third embodiment, two engagement holes 1015A and 1015B formed in the cymbal 1010 are connected to each other through the damping piece 1030. Both the engagement holes 1015A and 1015B are engagement function portions which are provided in positions closer to an edge portion 1013 than a cup portion 1011 in a radial direction. The damping piece 1030 shown in FIG. 4C corresponds to a configuration in which the attachment portion 1033 in the damping piece 1030 configured as shown in FIG. 1C is provided on each of opposite ends of a connection portion 1031. That is, a hook-like attachment portion 1033A is formed in one end portion 1031*a* of the connection portion 1031 in a longitudinal direction, and a hook-like attachment portion 1033B is formed in the other end portion 1031*b* of the connection portion 1031. A length of the connection portion 1031 (a length between the attachment portions 1033A and 1033B) is set to be slightly shorter than a distance between the engagement holes 1015A and 1015B.

Regardless of whether the cymbal 1010 has been supported on a rod 1021 or not, the attachment portion 1033A in the one end portion 1031*a* of the damping piece 1030 can be inserted into the engagement hole 1015A from below so as to be engaged therewith, and the attachment portion 1033B in the other end portion 1031*b* can be inserted into the engagement hole 1015B from below so as to be engaged therewith. In this manner, the connection portion 1031 is brought into a tensile state. Due to elasticity of the connection portion 1031, the engagement holes 1015A and 1015B are urged in directions to approach each other. Urging forces F3 toward each other can act on the engagement holes 1015A and 1015B (FIG. 4B). Thus, the urging forces do not have to be directed toward the radial center of the cymbal 1010 in order to obtain a damping effect.

According to the embodiment, it is possible to obtain the same effect as in the first embodiment in order to reduce volume without excessively affecting hitting sound.

However, it is desirable that the engagement holes 1015A and 1015B as the subjects to be connected by the damping piece 1030 are provided in positions as close to the edge portion 1013 as possible. This is because a higher volume reduction effect can be obtained as a region which receives tension in a compression direction is closer to the edge portion 1013. For the same reason, it is desirable that the engagement hole 1015 is close to the edge portion 1013 in the first embodiment, and the edge portion 1013*x* is set as the subject to be engaged in the second embodiment.

Figure 4D:
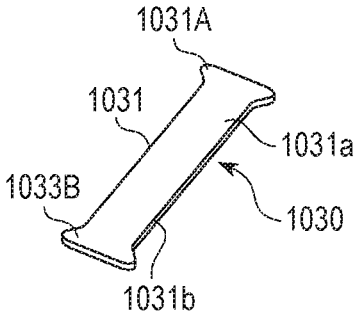

Incidentally, a modification shown in FIG. 4D may be used as the damping piece 1030 in the embodiment. That is, the example shown in FIG. 1D may be applied so that one or each of the attachment portions 1033A and 1033B of the damping piece 1030 can be not shaped like a hook but formed into a wide shape. Incidentally, the example shown in FIG. 1E may be applied so that one or each of a metal fitting where the attachment portion 1033A is formed and a metal fitting where the attachment portion 1033B is formed can be provided.

The configuration in which one end of the damping piece 1030 is connected to the rod 1021 and another end of the damping piece 1030 is connected to the engagement hole 1015 or the edge portion 1013 of the cymbal 1010 has been described in the first or second embodiment. In addition, the configuration in which the engagement holes 1015 are connected to each other has been shown by way of example in the third embodiment. However, the engagement portions as the subjects to be connected by the damping piece 1030 are not limited to the illustrated ones.

For example, in the first and second embodiments, when the first engagement portion as one of the subjects to be connected is regarded as the insertion hole 1014 of the cymbal 1010, the stand 1100 or the portion (the rod 1021 etc.) fixed to the stand 1100, the second engagement portion as the other of the subjects to be connected may be the edge portion 1013 per se or the engagement function portion provided in a position closer to the edge portion 1013 than the cup portion 1011 in the bow portion 1012. When this is applied to the third embodiment, a plurality of engagement portions as the subjects to be connected may include the edge portion 1013 per se in the cymbal 1010 or the engagement function portions provided in positions closer to the edge portion 1013 than the cup portion 1011 in the bow portion 1012. It will go well in such a configuration that each of the engagement portions is in a connection relation to at least one of the others of the engagement portions through the damping piece 1030. Modifications satisfying these conditions will be described with reference to FIGS. 5A to 5C and FIGS. 6A to 6L.

Figure 5A:
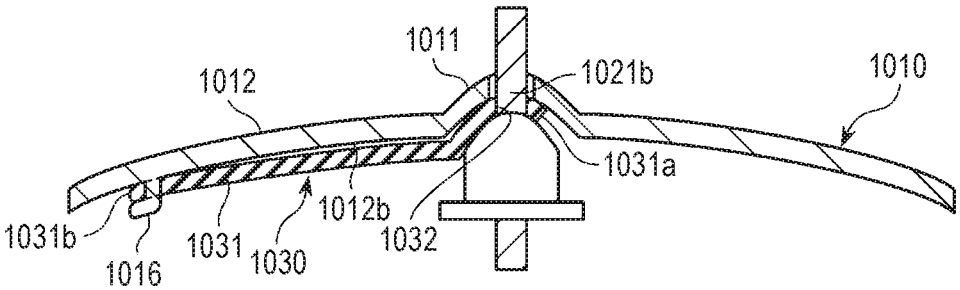
FIGS. 5A to 5C are schematic views showing cymbals to which damping pieces according to modifications are applied respectively.
Figure 5B:
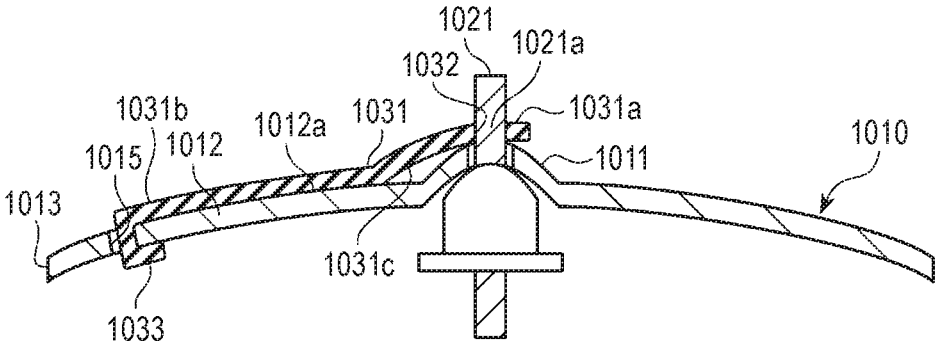
Figure 5C:
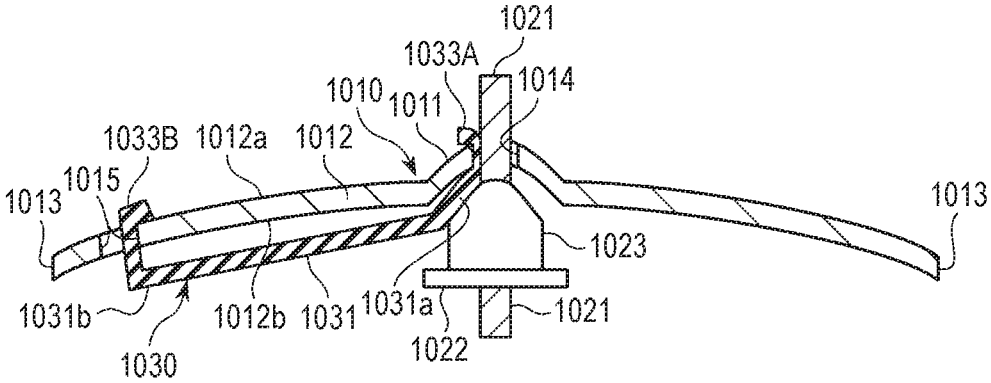

FIGS. 5A, 5B and 5C are schematic sectional views of cymbals to which damping pieces according to the modifications are applied. First, an example shown in FIG. 5A can be mainly applied to the first embodiment so that a hook 1016 is formed on a back face 1012*b* of a bow portion 1012. The position of the hook 1016 is the same as that of the engagement hole 1015 (FIG. 1A). The hook 1016 is an example of the "second engagement portion". A rod 1021 is inserted into an attachment hole 1032 in one end portion 1031*a* of the damping piece 1030 to be engaged therewith. This point is the same as that in the first embodiment. On the other hand, the same attachment hole as the attachment hole 1032 is provided in the other end portion 1031*b* of the damping piece 1030 to be engaged with the hook 1016.

An example shown in FIG. 5B can be mainly applied to the first embodiment, but the damping piece 1030 is disposed on not a back side but a front side of a cymbal 1010. The configuration shown in FIG. 1C can be fundamentally used as the configuration of the damping piece 1030. A curved portion 1031*c* convex upward is formed in a connection portion 1031 of the damping piece 1030. An attachment hole 1032 in one end portion 1031*a* of the damping piece 1030 is engaged with a portion 1021*a* of the rod 1021 on an upper side of a cup portion 1011. The portion 1021*a* is an example of the "first engagement portion". An attachment portion 1033 in the other end portion 1031*b* of the damping piece 1030 is inserted into the engagement hole 1015 from above so as to be engaged therewith. The curved portion 1031*c* is in a non-abutment state with a front face 1012*a* of a bow portion 1012.

Incidentally, the connection portion 1031 in at least a part of a region facing the bow portion 1012 has a shape which is not limited to the shape like the curved portion 1031*c* but may be any shape as long as it can be in a non-abutment state with the bow portion 1012. In addition, the shape like the curved portion 1031*c* may be provided in the middle of the connection portion 1031 in a radial direction of the cymbal 1010.

An example shown in FIG. 5C can be mainly applied to the first embodiment. The damping piece 1030 preferably has the configuration shown in FIG. 4C. Before the cymbal 1010 is supported on the rod 1021, an attachment portion 1033A in one end portion 1031*a* of the damping piece 1030 is inserted into an insertion hole 1014 from below so as to be engaged therewith and an attachment portion 1033B in the other end portion 1031*b* of the damping piece 1030 is inserted into an engagement hole 1015 from below so as to be engaged therewith. The attachment portion 1033A is an example of the "first engagement portion" and the engagement hole 1015 is an example of the "second engagement portion".

Incidentally, in the example of FIG. 5B or 5C, the attachment portion 1033 or the engagement portion 1033B may be hooked on the edge portion 1013 so as to be engaged therewith as in the example of FIG. 3A. In these cases, the edge portion 1013 serves as the "second engagement portion". In addition, in the example shown in FIG. 4A, the damping piece 1030 may be disposed on the front side of the cymbal 1010.

FIGS. 6A to 6L are schematic views of cymbals 1010 mounted with damping pieces 1030 according to modifications. In FIGS. 6A to 6L, each white circle corresponds to an engagement hole 1015 (FIG. 1A etc.) provided in the cymbal 1010. However, the white circle may designate a hook 1016 (FIG. 5A) alternatively. Of an edge portion 1013, an edge portion 1013*x* is a place with which the damping piece 1030 is engaged. As the shape of a portion of the damping piece 1030 engaged with each engagement portion, a hook shape, a hole, etc. may be used suitably in accordance with the shape of the engagement portion.

The number of the engagement portions as subjects to be connected by the damping piece 1030 or the damping pieces 1030 may be three (FIGS. 6A to 6D and 6J), four (FIGS. 6E to 6H) or five (FIG. 6I), or may be six or more. In addition, configuration may be made so that all three or more engagement portions can be connected by the damping piece 1030 alone (FIGS. 6A, 6D, 6E, 6H, 6I and 6J). Alternatively, two or more damping pieces 1030 which connect ones of the engagement portions to each other may be provided (FIGS. 6B, 6C, 6F and 6G).

Figure 6A:
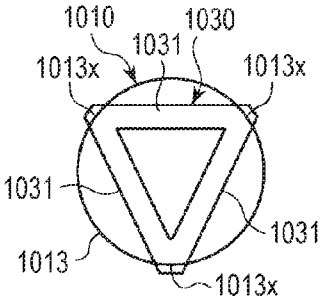
FIGS. 6A to 6L are schematic bottom views of cymbals mounted with damping pieces according to modifications.
Figure 6B:
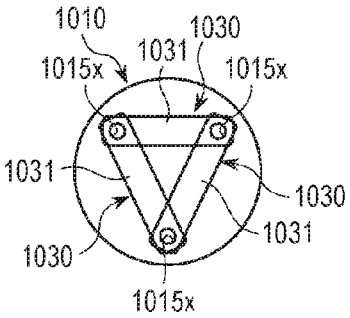
Figure 6C:
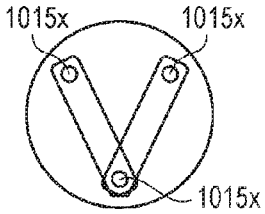
Figure 6D:
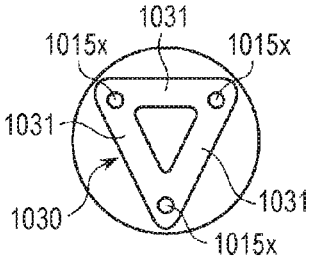
Figure 6E:
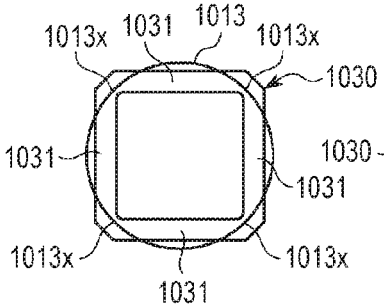
Figure 6F:
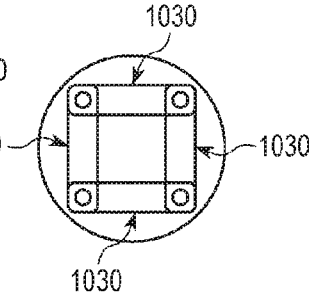
Figure 6G:
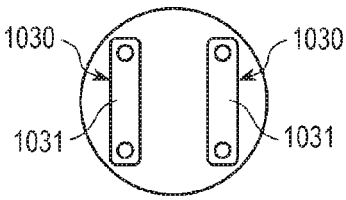
Figure 6H:
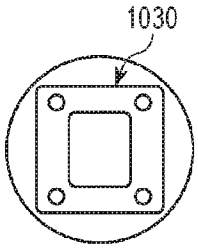
Figure 6I:
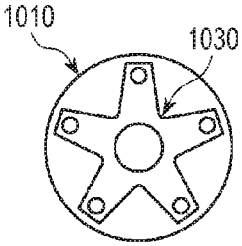
Figure 6J:
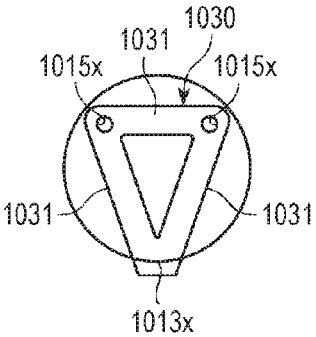
Figure 6K:
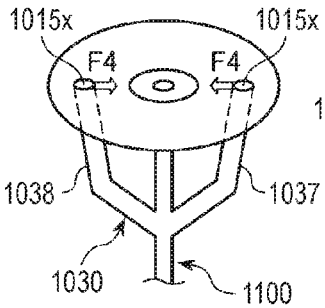

In addition, as shown in FIG. 6K, configuration in which urging forces can be exerted may be provided in a stand 1100. In this case, the damping piece 1030 constitutes a part of the stand 1100. First, an arm portion 1037 and an arm portion 1038 are provided in the stand 1100 and an interval between front ends of the arm portion 1037 and the arm portion 1038 in a free state is set to be shorter than a distance between two engagement holes 1015*x* provided in the cymbal 1010. The arm portion 1037 and the arm portion 1038 are engaged with the engagement holes 1015*x* respectively. Thus, urging forces F4 are applied between the two engagement holes 1015*x* in directions to approach each other. In this case, configuration may be made in such a manner that the arm portion 1037 and the arm portion 1038 can expand/compress or move desirably with respect to a stand body in order to allow the cymbal 1010 to swing.

Figure 6L:
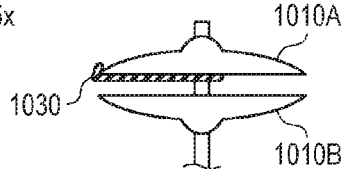

Incidentally, although the damping piece 1030 or the damping pieces 1030 are disposed on the back side of the cymbal 1010 in FIGS. 6A to 6J, the damping piece 1030 or the damping pieces 1030 may be disposed on the front side of the cymbal 1010. In addition, although each of the examples in which the invention is applied to a cymbal has been described above, the invention may be applied to a hi-hat cymbal, as illustrated in FIG. 6L. In this case, for example, mounting of any of the aforementioned damping pieces 1030 is applied to one or each of an upper cymbal 1010A and a lower cymbal 1010B. Incidentally, although there is a case where a solid portion of the damping piece 1030 is interposed between the upper cymbal 1010A and the lower cymbal 1010B, there is no problem if the solid portion of the damping piece 1030 is located partially in a circumferential direction. That is, it is because, during clashing between the two cymbals, the two cymbals can clash with each other properly to generate sound in a place where the solid portion of the damping piece 1030 is absent.

Incidentally, in the aforementioned examples, the length of the connection portion is set in advance so that a proper urging force or urging forces can be exerted. However, adjustment mechanisms for adjusting the length of the connection portion may be provided as shown in FIGS. 7A to 7C.

Figure 7A:
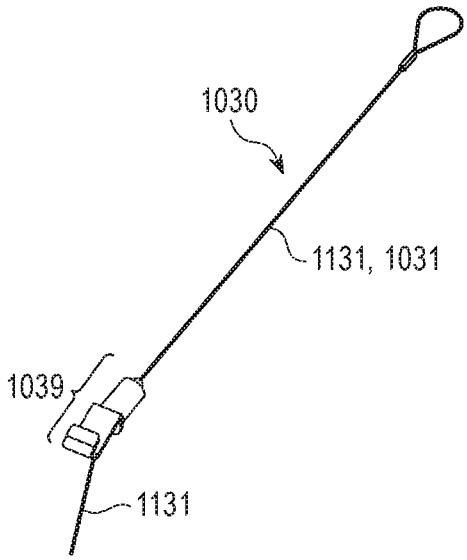
FIGS. 7A to 7C are views showing examples of an adjustment mechanism for adjusting a length of a connection portion.

For example, the following configuration may be made as shown in FIG. 7A. That is, a lock mechanism 1039 which can change a lock position relative to a wire 1131 may be provided so that, of the wire 1131, the length corresponding to the connection portion 1031 can be changed stepwise. Configuration in which the angle of the lock mechanism 1039 is changed to lock or release the wire 1131 may be conceived regardless of the configuration of the lock mechanism 1039. A length adjustment mechanism which can adjust the length continuously may be used.

Figure 7B:
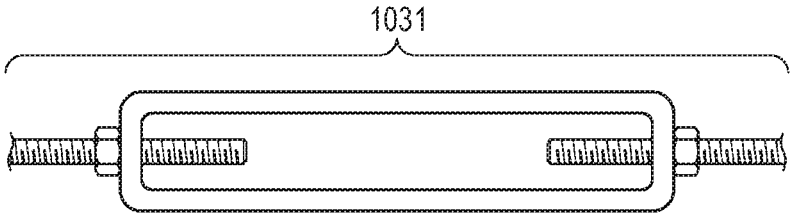
Figure 7C:
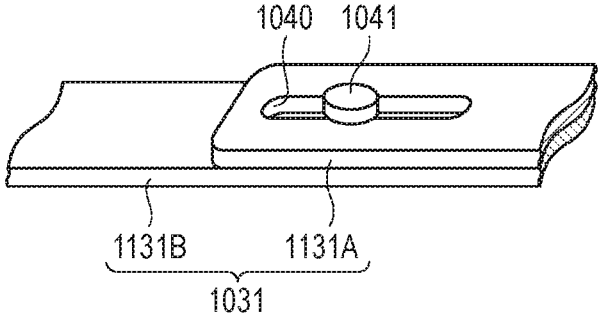

As shown in FIG. 7B, a turnbuckle mechanism may be used for the connection portion 1031. A turnbuckle of any form such as a split frame form or a pipe form may be used. Alternatively, the following configuration may be made as shown in FIG. 7C. That is, the connection portion 1031 is constituted by two plate members 1131A and 1131B and the plate member 1131A is coupled to the plate member 1131B by a bolt 1041 through a long hole 1040 provided in the plate member 1131A. The entire length of the connection portion 1031 can be adjusted by a fastening position of the bolt 1041 relative to the long hole 1040.

With such an adjustment mechanism, the degree of damping can be adjusted. In addition, the damping piece 1030 may be made of inelastic metal alone etc. For example, with the configuration in FIG. 7A or 7B, the length of the connection portion 1031 can be easily adjusted manually after the opposite end portions of the damping piece 1030 are engaged to engagement portions as subjects to be engaged. Accordingly, it is possible to give suitable tension to the cymbal 1010 even by the damping piece 1030 made of metal.

Fourth Embodiment

In the configuration which has been described above, the damping piece 1030 is disposed on either the front side or the back side of the cymbal 1010. However, the damping piece 1030 may be disposed separately on each of the front side and the back side of the cymbal 1010. In addition, an integrated damping piece 1030 which is disposed on the front side and the back side of the cymbal 1010 may be used as will be described as a fourth embodiment.

Figure 8A:
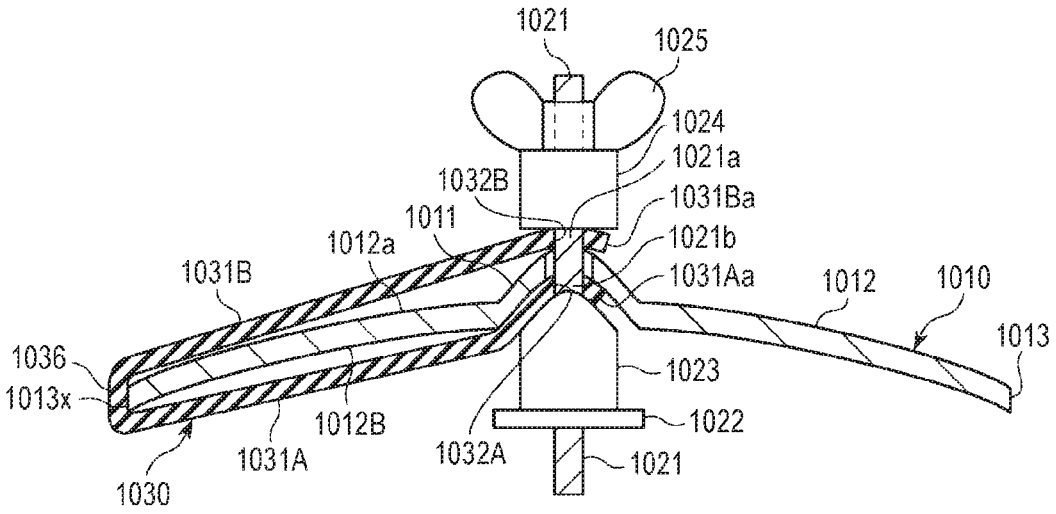
FIG. 8A is a schematic sectional view of a cymbal to which a damping piece according to a fourth embodiment is applied.
Figure 8B:
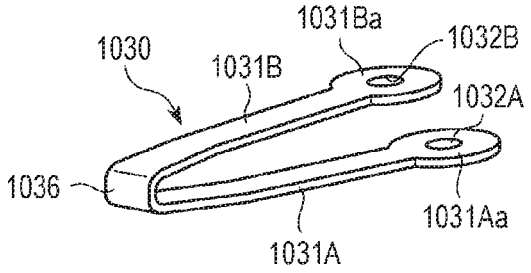
FIG. 8B is a perspective view of the damping piece.

FIG. 8A is a schematic sectional view of a cymbal to which a cymbal according to the fourth embodiment is applied. FIG. 8B is a perspective view of a damping piece 1030.

As shown in FIG. 8B, the damping piece 1030 has an upper connection portion 1031B and a lower connection portion 1031A, which serve as a connection portion 1031. An attachment hole 1032A is formed in an end portion 1031Aa of the lower connection portion 1031A which also serves as one end portion of the connection portion 1031, and an attachment hole 1032B is formed in an end portion 1031Ba of the upper connection portion 1031B which also serves as the other end portion of the connection portion 1031. The upper connection portion 1031B and the lower connection portion 1031A are coupled to each other through a coupling portion 1036. Incidentally, it is not necessary to give a bending habit to the connection portion 1031 in the coupling portion 1036 in advance. A range of from the end portion 1031Aa to the end portion 1031Ba through the coupling portion 1036 may be flat in a free state.

As shown in FIG. 8A, a side of a rod 1021 on an upper side of a cup portion 1011 is fastened by a clamp 1025 through a buffer material 1024. The attachment hole 1032A is engaged with a portion 1021*b* (lower engagement portion) interposed between the cup portion 1011 and a buffer material 1023. The attachment hole 1032B is engaged with a portion 1021*a* (upper engagement portion) of the rod 1021 interposed between the cup portion 1011 and the buffer material 1024.

In the configuration, in order to support the cymbal 1010 on the rod 1021, first, the rod 1021 is inserted into the attachment hole 1032A from below so that the end portion 1031Aa of the lower connection portion 1031A can be interposed between the cup portion 1011 and the buffer material 1023. Next, the coupling portion 1036 is put around an edge portion 1013*x* and the rod 1021 is inserted into the attachment hole 1032B so that the end portion 1031Ba of the upper connection portion 1031B can be interposed between the cup portion 1011 and the buffer material 1024. Then, the end portion 1031Ba and the buffer material 1024 are fastened by the clamp 1025 from the upper side of the cup portion 1011.

A length of the connection portion 1031 (a length between the attachment holes 1032A and 1032B) is slightly shorter than a distance between the portion 1021*b* and the portion 1021*a* through the edge portion 1013*x*. Thus, the lower connection portion 1031A and the upper connection portion 1031B are brought into a tensile state respectively. Due to elasticity of the lower connection portion 1031A and the upper connection portion 1031B, the edge portion 1013*x* is urged toward a place where the portions 1021*b* and 1021*a* are located, i.e. toward the radial center of the cymbal 1010. When considered in contrast with the first embodiment, the portions 1021*b* and 1021*a* correspond to the "first engagement portions" respectively, and the edge portion 1013*x* corresponds to the "second engagement portion".

Incidentally, the shape of a curved portion corresponding to the curved portion 1031*c* (FIG. 5B) in the middle of the upper connection portion 1031B in the radial direction of the cymbal 1010 may be used.

According to the embodiment, it is possible to obtain the same effect as that in the first embodiment in order to reduce volume without excessively affecting hitting sound. In addition, the cymbal 1010 does not have to have any engagement hole. Accordingly, versatility of the damping piece 1030 is also wide. In addition, since the configuration of the damping piece 1030 is simple, manufacturing cost can be reduced. Since sound can be damped from the opposite front and back sides, a sound damping effect is high.

Incidentally, in the configuration of FIGS. 8A and 8B, a hook-like attachment portion 1033A (FIG. 5C) may be used in place of the attachment holes 1032A and 1032B in one or each of the end portion 1031Aa of the lower connection portion 1031A and the end portion 1031Ba of the upper connection portion 1031B.

Fifth Embodiment

Figure 9A:
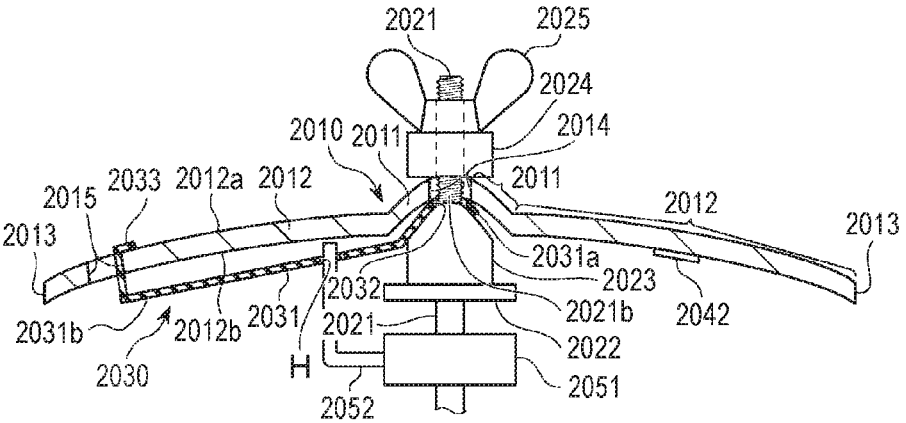
FIG. 9A is a schematic sectional view of a cymbal type percussion instrument according to a fifth embodiment.
Figure 9B:
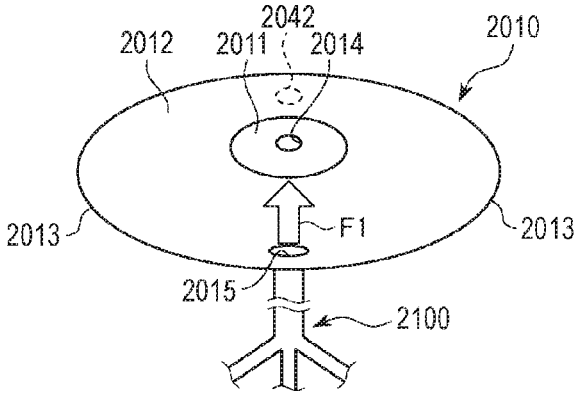
FIG. 9B is a schematic perspective view of a cymbal seen obliquely from top.

FIG. 9A is a schematic sectional view of a cymbal type percussion instrument according to a fifth embodiment of the present invention. FIG. 9B is a schematic perspective view of the cymbal type percussion instrument seen obliquely from top (front). The cymbal type percussion instrument has an acoustic cymbal 2010 (hereinafter referred to as cymbal 2010 simply) which is mainly made of metal. The cymbal 2010 has basic characteristics as an acoustic percussion instrument which is performed in such a manner that it is hit by a performer to make vibration to thereby produce performance sound. In addition, the cymbal 2010 also has characteristics as an electronic instrument which electronically produces music correspondingly to hitting detected by a hitting sensor as will be described later.

The cymbal 2010 has a cup portion 2011, and a bow portion 2012 which is coupled to the cup portion 2011. The cup portion 2011 and the bow portion 2012 are formed integrally into a disk shape. The cup portion 2011 bulges slightly upward in a bowl shape from the bow portion 2012. An insertion hole 2014 is formed in the center of the cup portion 2011. An outer circumferential edge of the bow portion 2012 serves as an edge portion 2013. When being placed horizontally, the bow portion 2012 is curved gently so as to be inclined downward as it goes toward an outer side in a radial direction. The bow portion 2012 has a front face 2012*a* and a back face 2012*b*. The front face 2012*a* is a face which is mainly hit. In addition thereto, the edge portion 2013 or the cup portion 2011 may be also a subject to be hit.

The cymbal 2010 is supported by a stand 2100 (FIG. 9B) serving as a support having a rod 2021. As a damping device for reducing hitting sound of the cymbal 2010, a damping piece 2030 is mounted on the cymbal 2010. The cup portion 2011 and a connection portion 2031 of the damping piece 2030 are interposed between an upper buffer material 2024 and a lower buffer material 2023. The lower buffer material 2023 is disposed on a pedestal 2022. The rod 2021 is inserted into the insertion hole 2014 of the cup portion 2011 from below and fastened by a clamp 2025 through the buffer material 2024. The clamp 2025 serves as a wing nut. Thus, the cymbal 2010 is supported on the rod 2021. The rod 2021 is fitted to the insertion hole 2014 loosely. The cymbal 2010 can swing with respect to the rod 2021 to some degree. In addition, as to rotation, the cymbal 2010 can rotate in a restriction range restricted by a restriction portion 2052 which will be described later. Incidentally, the buffer material 2023 may be shaped like a cylinder.

A hitting sensor 2042 is disposed on the back face 2012*b* of the bow portion 2012. The hitting sensor 2042 includes a piezoelectric device etc. which detects vibration of the cymbal 2010. The configuration of the hitting sensor 2042 is not limited. Although not shown, the percussion instrument has a music generating portion having a sound source, and a music control portion including a CPU. The music control portion makes control to generate sound from the music generating portion based on a detection result of the hitting sensor 2042. Incidentally, whether to generate music based on a detection result of the hitting sensor 2042 or not can be designated arbitrarily by a performer by mode change.

A fixation portion 2051 is fixed to the rod 2021 under a pedestal 2022. A fixation form of the fixation portion 2051 is not limited. The fixation portion 2051 may be formed integrally with the rod 2021. A restriction portion 2052 is fixed to the fixation portion 2051. In an example of FIG. 9A, the restriction portion 2052 is a protruding stick formed into an L-shape in side view. However, the restriction portion 2052 can have any form of external appearance. The restriction portion 2052 can be fixed to the fixation portion 2051 in any form. The restriction portion 2052 may be formed integrally with the fixation portion 2051. In any case, the restriction portion 2052 has a fixation relation to the stand 2100 through the fixation portion 2051. The fixation portion 2051 and the restriction portion 2052 are made of a high-rigidity material such as metal or a hard resin.

An upper end of the restriction portion 2052 is inserted into a lock portion H which serves as a lock hole formed in the connection portion 2031 of the damping piece 2030. Thus, rotation of the damping piece 2030 can be restricted. The damping piece 2030 cannot rotate freely relatively to the cymbal 2010. Accordingly, a rotation range of the cymbal 2010 can be restricted through the damping piece 2030.

Figure 9C:
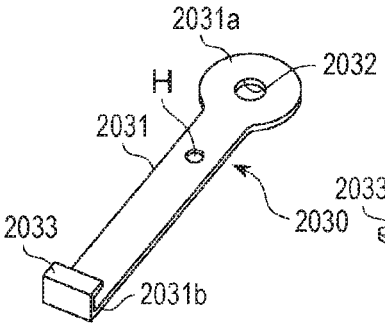
FIGS. 9C, 9D and 9E are perspective views of damping pieces.

FIG. 9C is a perspective view of the damping piece 2030. In FIG. 9A, the damping piece 2030 is illustrated to be thick in thickness with exaggeration. The damping piece 2030 has the connection portion 2031 which is formed integrally as an elastic member such as rubber, an electric resin or a spring. Incidentally, any other portion than the connection portion 2031 in the damping piece 2030 may be constituted by a harder member than the connection portion 2031. An attachment hole 2032 is formed in one end portion 2031*a* of the connection portion 2031 in a longitudinal direction, and a hook-like attachment portion 2033 is formed in the other end portion 2031*b* of the connection portion 2031. The attachment hole 2032 has a size large enough to be penetrated by the rod 2021. The lock portion H for locking the restriction portion 2052 is formed in the connection portion 2031. The lock portion H is formed between the attachment hole 2032 and the attachment portion 2033.

An engagement hole 2015 is formed in the bow portion 2012 (FIGS. 9A and 9B). The engagement hole 2015 is an engagement function portion which is provided in a position closer to the edge portion 2013 than the cup portion 2011 in the radial direction. In the embodiment, the engagement hole 2015 is an example of a "second engagement portion".

The damping piece 2030 connects a portion 2021*b* of the rod 2021 and the engagement hole 2015 to each other. The portion 2021*b* is interposed between the cup portion 2011 and the buffer material 2023. In the embodiment, particularly the portion 2021*b* of the rod 2021 is an example of a "first engagement portion". That is, in order to support the cymbal 2010 on the rod 2021, the rod 2021 is inserted into the attachment hole 2032 of the damping piece 2030 so that the one end portion 2031*a* of the damping piece 2030 can be interposed between the cup portion 2011 and the buffer material 2023, and the cup portion 2011 and the one end portion 2031*a* of the damping piece 2030 are fastened by the clamp 2025 through the buffer material 2024. Further, the attachment portion 2033 in the other end portion 2031*b* of the damping piece 2030 is inserted into the engagement hole 2015 from below so as to be engaged therewith.

A length of the connection portion 2031 (a length between the attachment hole 2032 and the attachment portion 2033) in a free state is set to be slightly shorter than a distance between the portion 2021*b* and the engagement hole 2015. Accordingly, when the attachment hole 2032 is engaged with the portion 2021*b* and the attachment portion 2033 is engaged with the engagement hole 2015, the connection portion 2031 is brought into a tensile state. Due to elasticity of the connection portion 2031, the connection portion 2031 urges the portion 2021*b* and the engagement hole 2015 in a direction to approach each other. The portion 2021*b* is a part of the rod 2021 fixed to the stand 2100. Accordingly, an urging force F1 toward the radial center of the cymbal 2010 where the insertion hole 2014 is located acts on the engagement hole 2015 relatively (FIG. 9B). As a result, as the cymbal 2010, the insertion hole 2014 and the engagement hole 2015 are urged in a direction to approach each other.

The connection portion 2031 is in a non-abutment state with the bow portion 2012 in at least a part of a region facing the back face 2012*b* of the bow portion 2012. In the example of FIG. 9A, the bow portion 2012 is curved to be convex upward. Accordingly, the connection portion 2031 is in a non-abutment state with the bow portion 2012 in almost the entire region.

The attachment portion 2033 of the damping piece 2030 is exposed on the front side of the cymbal 2010. For this reason, a performer may want to hit a region in which the attachment portion 2033 is absent, so that the attachment portion 2033 cannot be an obstacle. In addition, it is desirable that a region close to the location of the hitting sensor 2042 in a circumferential direction is hit in order to stabilize detection accuracy of hitting by the hitting sensor 2042. Therefore, in the embodiment, the hitting sensor 2042 is disposed in a region on an opposite side to the engagement hole 2015 across the insertion hole 2014. Assume that the cymbal 2010 is configured to rotate freely. In this case, the hitting position of the cymbal 2010 in the circumferential direction changes at all times. At one time the attachment portion 2033 approaches the region where hitting is being performed while the hitting sensor 2042 leaves the same region at another time. Therefore, there is a fear that the performer cannot hit the proper position.

Therefore, in the embodiment, the damping piece 2030 serving as a mounting member mounted on the cymbal 2010 is used to indirectly restrict rotation of the cymbal 2010 based on insertion/engagement between the lock portion H of the connection portion 2031 and the restriction portion 2052. To set the position of the cymbal 2010 in a rotation direction, the performer may perform after locating the vicinity of the hitting sensor 2042 in a range where the performer expects to hit the cymbal 2010. Due to restriction of rotation of the cymbal 2010, the performer can hit the vicinity of the hitting sensor 2042 while keeping away from the attachment portion 2033. Incidentally, rotation of the cymbal 2010 does not have to be stopped completely even during rotation restriction. Accordingly, the relation between the lock portion H and the restriction portion 2052 may be loose fitting.

The restriction portion 2052 can be locked to the lock portion H in the state in which the damping piece 2030 has been mounted on the cymbal 2010. That is, since the damping piece 2030 has elasticity, it is easy to insert the restriction portion 2052 into the lock portion H by use of the elasticity of the connection portion 2031. Incidentally, an elastic characteristic of bending in an up/down direction may be also provided in the restriction portion 2052.

Figure 10:
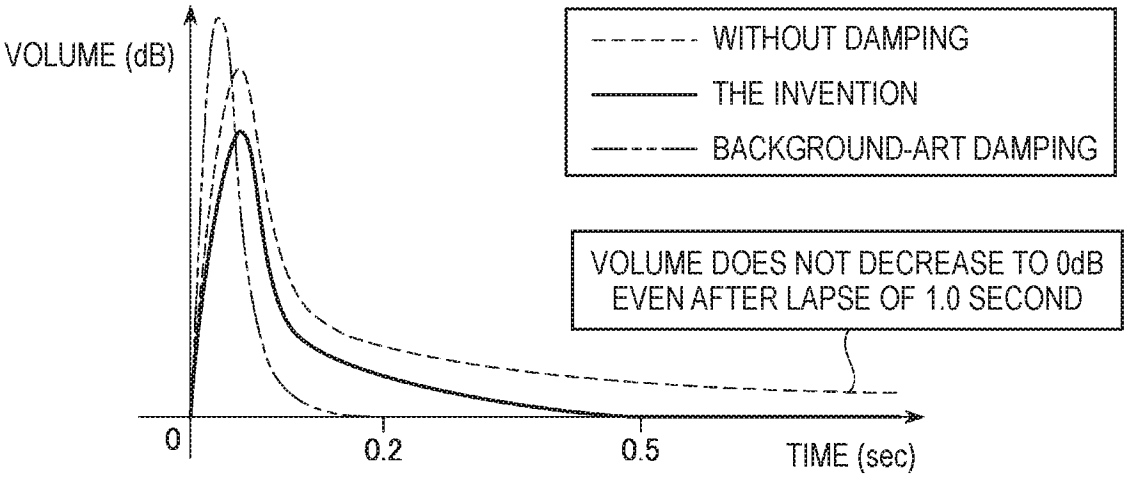
FIG. 10 is a graph showing temporal change in volume of hitting sound due to mounting with/without a damping piece.

FIG. 10 is a graph showing temporal change in volume of hitting sound due to mounting with/without a damping piece. In FIG. 10, the abscissa designates elapsed time (second) after hitting, and the ordinate designates volume (dB). When no damping piece is mounted, the volume does not decrease to 0 dB even after a lapse of about 1.0 second. On the other hand, when the damping piece according to the background art is mounted to mute sound substantially completely, the sound is completely attenuated before a lapse of about 0.2 seconds. On the contrary, when the damping piece 2030 according to the embodiment is mounted, the volume is attenuated to 0 dB after a lapse of about 0.5 seconds. Pay attention to the maximum level. The maximum level in the case where the damping piece 2030 according to the embodiment is mounted is suppressed to be lower than that in any of the case where no damping piece is mounted and the case where the damping piece according to the background art is mounted. That is, it is possible to suppress the volume to be lower while keeping a moderate attenuation time of the sound.

According to analysis of the present applicant, it has been proved that such an effect can be obtained when the insertion hole 2014 and the engagement hole 2015 are urged in a direction to approach each other in the cymbal 2010. In the embodiment which is different from the background-art configuration in which a soft damping piece is mounted on the cymbal, tension in a compression direction is applied to apart of the cymbal 2010 so that volume can be suppressed to be lower without excessively attenuating sound rich in a high frequency.

In addition, the connection portion 2031 of the damping piece 2030 has a region which belongs to the region facing the bow portion 2012 and which is in a non-abutment state with the bow portion 2012. Accordingly, vibration of the bow portion can be prevented from being suppressed in a wide area as in a configuration in which the connection portion 2031 touches the bow portion in the entire region as described in the background art. Thus, hitting sound can be prevented from changing largely from original cymbal sound.

According to the embodiment, the restriction portion 2052 is fixed to the fixation portion 2051 fixed to the rod 2021 of the stand 2100, and the restriction portion 2052 is locked to the lock portion H of the damping piece 2030. Thus, it is possible to restrict the cymbal 2010 from rotating. It is possible to perform hitting in the proper region which is always fixed by the rotation restriction. Accordingly, it is possible to prevent the damping piece 2030 from becoming an obstacle to hitting. In addition, detection accuracy performed by the hitting sensor 2042 is stable. Moreover, the damping piece 2030 mounted on the cymbal 2010 is used for the rotation restriction. Accordingly, additional treatment for forming a hole, a lock portion, etc. in the cymbal 2010 is not necessarily performed only for the purpose of the rotation restriction. Thus, application of the damping piece 2030 to any widely used cymbal becomes easy. Accordingly, no special treatment etc. is performed on the acoustic cymbal so that it is possible to produce sound with the volume, the tone, etc. as the acoustic cymbal. In addition, it is possible to restrict the rotation range of the cymbal to increase the detection accuracy of hitting, and it is possible to prevent the damping piece 2030 from becoming an obstacle to hitting. In addition, since the damping piece 2030 is used, it is not necessary to increase the number of constituent components.

According to the embodiment, the damping piece 2030 is mounted. Thus, it is possible to reduce the volume without excessively affecting hitting sound.

In addition, in the damping piece 2030, the portion which is exposed on the front side of the cymbal 2010 is only the attachment portion 2033. Accordingly, it is possible to secure a large region where the damping piece 2030 does not have to be hit directly, i.e. a large hitting area where feeling of hitting does not change, in comparison with the background-art configuration in which the cymbal is largely covered with the damping piece from above. Accordingly, it is possible to reduce the possibility that the feeling of hitting may be spoiled. In addition, it is also possible to prevent external appearance of the cymbal 2010 from changing largely. Moreover, the connection portion 2031 of the damping piece 2030 is constituted by an elastic member to exert an urging force due to its elasticity. Accordingly, it is possible to generate an urging force with a simple configuration.

Figure 9D:
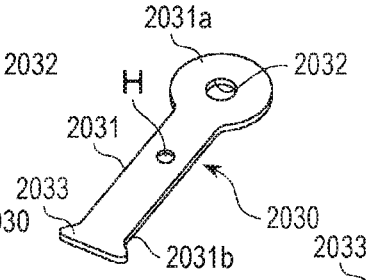
Figure 9E:
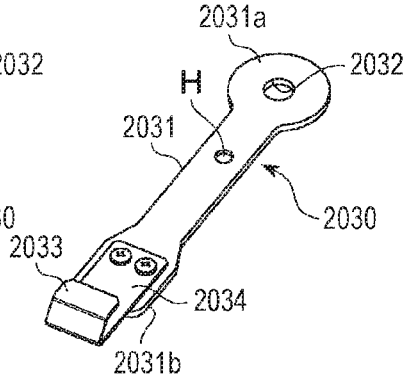

Incidentally, the configuration of the portion attached to the cymbal 2010 in the damping piece 2030 is not limited to the illustrated one. Several modifications will be described later. For example, modifications shown in FIGS. 9D and 9E may be used in the embodiment. That is, the attachment portion 2033 of the damping piece 2030 may be not shaped like a hook but formed into a wide shape (FIG. 9D). The wide attachment portion 2033 which is inserted into the engagement hole 2015 to be engaged therewith can also carry out the same function as that in FIG. 9C. The damping piece 2030 may be not formed integrally but a metal fitting 2034 may be attached to the other end portion 2031*b* and a hook-like attachment portion 2033 may be formed in the metal fitting 2034 alternatively, as shown in FIG. 9E. Incidentally, it may go well as long as at least a part (mainly the connection portion 2031) of the damping piece 2030 has elasticity. Accordingly, configuration may be made in such a manner that a metal fitting etc. where the attachment hole 2032 is formed is also attached to the one end portion 2031*a*.

Incidentally, the number of the engagement holes 2015 formed in the cymbal 2010 is not necessarily one, but one of the small holes used in the aforementioned Patent Literature 4 may be used.

Sixth Embodiment

Figure 11A:
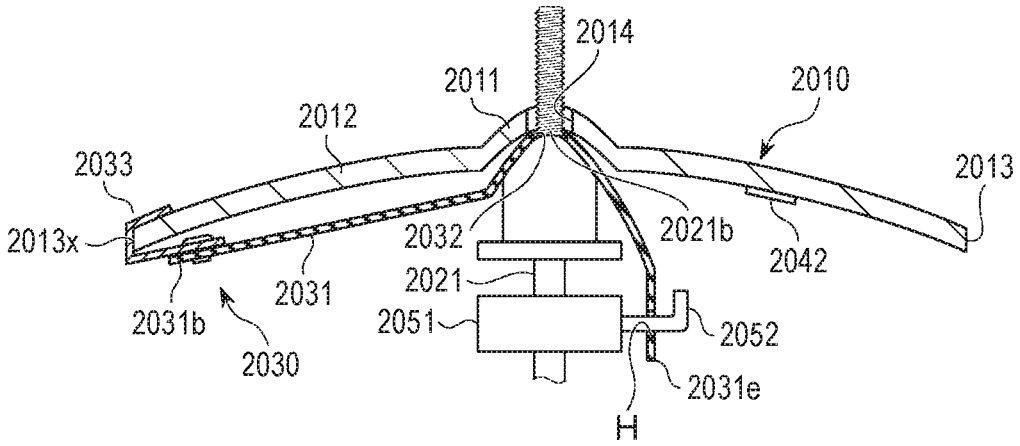
FIG. 11A is a schematic sectional view of a cymbal type percussion instrument according to a sixth embodiment.
Figure 11B:
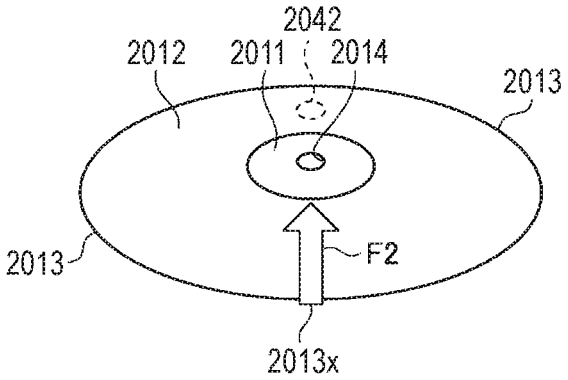
FIG. 11B is a schematic perspective view of a cymbal seen obliquely from top.
Figure 11C:
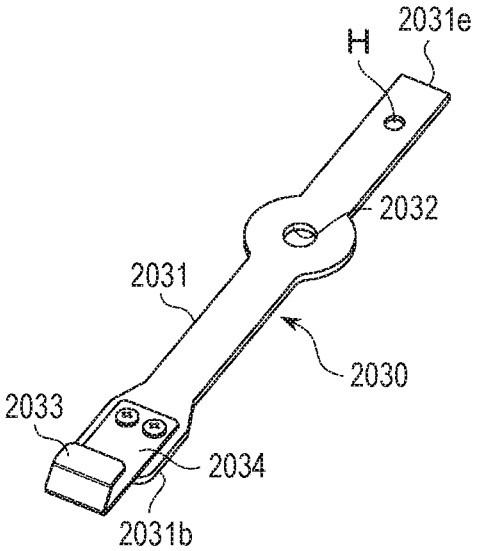
FIG. 11C is a perspective view of a damping piece.

FIG. 11A is a schematic sectional view of a cymbal type percussion instrument according to a sixth embodiment. FIG. 11B is a schematic perspective view of a cymbal seen obliquely from top. FIG. 11C is a perspective view of a damping piece 2030. A buffer material 2024, a clamp 2025, etc. are not shown in FIGS. 11A and 11B.

The fifth embodiment has a configuration in which the attachment portion 2033 of the damping piece 2030 is engaged with the engagement hole 2015 formed in the cymbal 2010. In contrast with this, the damping piece 2030 in the sixth embodiment is connected to an edge portion 2013 which is an outer circumferential edge of a bow portion 2012. In addition, the shape of the damping piece 2030 and the shape of a restriction portion 2052 engaged with the damping piece 2030 are made different from those in the fifth embodiment.

In the embodiment, the damping piece 2030 connects a portion 2021*b* of a rod 2021 and an edge portion 2013*x* to each other. The edge portion 2013*x* is an arbitrary place in a circumferential direction in the edge portion 2013 which is the outer circumferential edge of the bow portion 2012. The position of the edge portion 2013*x* is not limited. In the embodiment, the edge portion 2013*x* is an example of the "second engagement portion".

An attachment hole 2032 is formed in an intermediate portion of the damping piece 2030 in a longitudinal direction. A length between the attachment hole 2032 and the attachment portion 2033 in the damping piece 2030 is set to be slightly shorter than a distance between the portion 2021*b* and the edge portion 2013*x*. A lock portion H is formed in one end portion 2031*e* of the damping piece 2030 (FIGS. 11A and 11C). The attachment portion 2033 of the damping piece 2030 is exposed on a front side of the cymbal 2010. It is desirable that the damping piece 2030 is mounted so that the attachment portion 2033 can be positioned in a region on an opposite side to a hitting sensor 2042 across an insertion hole 2014.

As shown in FIG. 11A, the rod 2021 is inserted into the attachment hole 2032 of the damping piece 2030 so as to be engaged therewith. On the other hand, the hook-like attachment portion 2033 in the other end portion 2031*b* of the damping piece 2030 is hooked onto the edge portion 2013*x* from its lower outer circumferential side so as to be engaged therewith. When the attachment hole 2032 is engaged with the portion 2021*b* and the attachment portion 2033 is engaged with the edge portion 2013*x*, a connection portion 2031 is brought into a tensile state. Due to elasticity of the connection portion 2031, the connection portion 2031 urges the portion 2021*b* and the edge portion 2013*x* in a direction to approach each other. As a result, the insertion hole 2014 and the edge portion 2013*x* are urged in the direction to approach each other so that an urging force F2 toward the insertion hole 2014 can act on the edge portion 2013*x* (FIG. 11B). In addition, in the same manner as in the fifth embodiment, the connection portion 2031 is brought into a non-abutment state with the bow portion 2012 in almost the entire region.

In the cymbal 2010, the insertion hole 2014 and the edge portion 2013*x* are urged in a direction to approach each other. Accordingly, it is possible to obtain an effect that it is possible to suppress volume to be lower while keeping a moderate attenuation time of sound, as described in FIG. 10.

In addition, the side of the one end portion 2031*e* located more forward than the attachment hole 2032 in the damping piece 2030 is disposed to be curved and suspended downward. The embodiment has the same basic configuration as that in the fifth embodiment except the shape of a fixation portion 2051 and the shape of a restriction portion 2052. The restriction portion 2052 is inserted into the lock portion H formed in the one end portion 2031*e* of the damping piece 2030, to thereby restrict rotation of the damping piece 2030. Accordingly, a rotation range of the cymbal 2010 is restricted.

According to the embodiment, it is possible to restrict the rotation range without applying any special treatment etc. to the cymbal so that it is possible to increase detection accuracy of hitting. At the same time, it is possible to obtain the same effect as that in the fifth embodiment in order to prevent the damping piece 2030 from becoming an obstacle to hitting.

According to the embodiment, it is possible to obtain the same effect as that in the fifth embodiment in order to reduce the volume without excessively affecting hitting sound. In addition, it is not necessary to provide any engagement hole 2015 in the cymbal 2010. Accordingly, versatility of the damping piece 2030 is wider.

Incidentally, the shape of the damping piece 2030 and the position where the lock portion H is provided in the embodiment may be replaced with those in the fifth embodiment respectively. That is, in the fifth embodiment, the restriction portion 2052 may be locked to the lock portion H provided in a position extending further from the position of the attachment hole 2032 in the damping piece 2030 and then suspended downward. Or, in the sixth embodiment, the restriction portion 2052 may be locked to the lock portion H provided between the attachment hole 2032 and the attachment portion 2033.

Seventh Embodiment

Figure 12A:
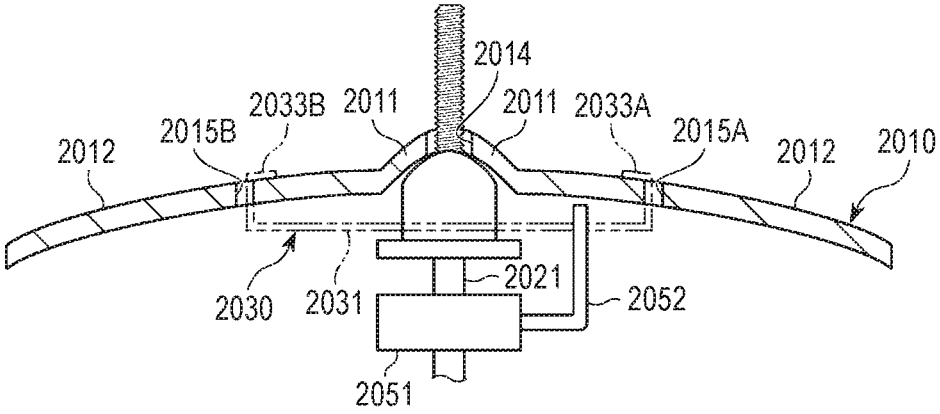
FIG. 12A is a schematic sectional view of a cymbal type percussion instrument according to a seventh embodiment.
Figure 12B:
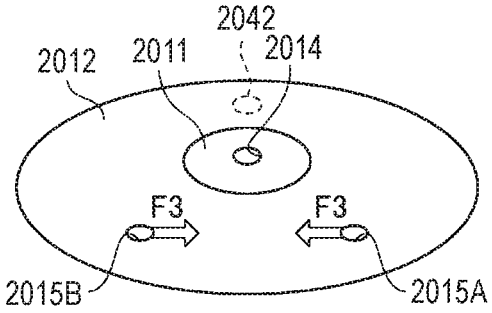
FIG. 12B is a schematic perspective view of a cymbal seen obliquely from top.
Figure 12C:
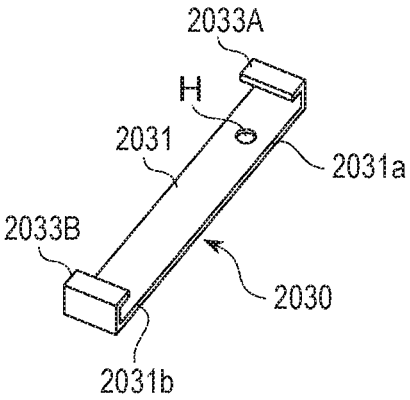
FIGS. 12C and 12D are perspective views of damping pieces.

FIG. 12A is a schematic sectional view of a cymbal type percussion instrument according to a seventh embodiment. FIG. 12B is a schematic perspective view of a cymbal seen obliquely from top. FIG. 12C is a perspective view of a damping piece 2030. A buffer material 2024, a clamp 2025, etc. are not shown in FIGS. 12A and 12B.

In the seventh embodiment, two engagement holes 2015A and 2015B formed in the cymbal 2010 are connected to each other through the damping piece 2030. Both the engagement holes 2015A and 2015B are engagement function portions which are provided in positions closer to an edge portion 2013 than a cup portion 2011 in a radial direction. The damping piece 2030 shown in FIG. 12C corresponds to a configuration in which the attachment portion 2033 in the damping piece 2030 configured as shown in FIG. 9C is provided on each of opposite ends of a connection portion 2031. That is, a hook-like attachment portion 2033A is formed in one end portion 2031*a* of the connection portion 2031 in a longitudinal direction, and a hook-like attachment portion 2033B is formed in the other end portion 2031*b* of the connection portion 2031. A length of the connection portion 2031 (a length between the attachment portions 2033A and 2033B) is set to be slightly shorter than a distance between the engagement holes 2015A and 2015B.

A lock portion H is formed in a position longitudinally closer to the attachment portion 2033A in the damping piece 2030 (FIG. 12C). The attachment portions 2033A and 2033B of the damping piece 2030 are exposed on a front side of the cymbal 2010. A hitting sensor 2042 is disposed in a region circumferentially far from both the engagement holes 2015A and 2015B in the damping piece 2030 (FIG. 12B).

Regardless of a temporal context as to whether the cymbal 2010 has been supported on a rod 2021 or not, the attachment portion 2033A in the one end portion 2031*a* of the damping piece 2030 can be inserted into the engagement hole 2015A from below so as to be engaged therewith, and the attachment portion 2033B in the other end portion 2031*b* of the damping piece 2030 can be inserted into the engagement hole 2015B from below so as to be engaged therewith. In this manner, the connection portion 2031 is brought into a tensile state. Due to elasticity of the connection portion 2031, the engagement holes 2015A and 2015B are urged in directions to approach each other. Urging forces F3 toward each other act on the engagement holes 2015A and 2015B (FIG. 12B). Thus, the urging forces do not have to be directed toward the radial center of the cymbal 2010 in order to obtain a damping effect.

The embodiment has the same basic configuration as the fifth embodiment except the shape of a fixation portion 2051 and the shape of a restriction portion 2052. An upper end of the restriction portion 2052 is inserted into the lock portion H formed in the connection portion 2031 of the damping piece 2030 so that rotation of the damping piece 2030 can be restricted. Accordingly, a rotation range of the cymbal 2010 can be restricted. The restriction portion 2052 and the damping piece 2030 cooperate with each other to function as a rotation restricting device for restricting the rotation range of the cymbal 2010.

According to the embodiment, it is possible to restrict the rotation range without applying any special treatment etc. to the cymbal so that it is possible to increase detection accuracy of hitting. At the same time, it is possible to obtain the same effect as that in the fifth embodiment in order to prevent the damping piece 2030 from becoming an obstacle to hitting.

According to the embodiment, it is possible to obtain the same effect as in the fifth embodiment in order to reduce volume without excessively affecting hitting sound.

However, it is desirable that the engagement holes 2015A and 2015B as the subjects to be connected by the damping piece 2030 are provided in positions as close to the edge portion 2013 as possible. This is because a higher volume reduction effect can be obtained as a region which receives tension in a compression direction is closer to the edge portion 2013. For the same reason, it is desirable that the engagement hole 2015 is close to the edge portion 2013 in the fifth embodiment, and the edge portion 2013*x* is set as the subject to be engaged in the sixth embodiment.

Figure 12D:
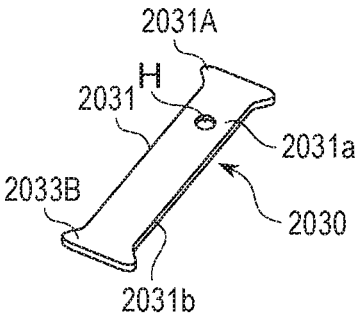

Incidentally, a modification shown in FIG. 12D may be used as to the damping piece 2030 in the embodiment. That is, the example shown in FIG. 9D may be applied so that one or each of the attachment portions 2033A and 2033B of the damping piece 2030 can be not shaped like a hook but formed into a wide shape. Incidentally, the example shown in FIG. 9E may be applied so that one or each of a metal fitting where the attachment portion 2033A is formed and a metal fitting where the attachment portion 2033B is formed can be provided.

The configuration in which one part of the damping piece 2030 is connected to the rod 2021 and another part of the damping piece 2030 is connected to the engagement hole 2015 or the edge portion 2013 of the cymbal 2010 has been described in the fifth or sixth embodiment. In addition, the configuration in which the engagement holes 2015 are connected to each other has been shown by way of example in the seventh embodiment. However, the engagement portions as the subjects to be connected by the damping piece 2030 are not limited to the illustrated ones.

For example, in the fifth and sixth embodiments, when the first engagement portion as one of the subjects to be connected is regarded as the insertion hole 2014 of the cymbal 2010, the stand 2100 or the portion (the rod 2021 etc.) fixed to the stand 2100, the second engagement portion as the other of the subjects to be connected may be the edge portion 2013 per se or the engagement function portion provided in a position closer to the edge portion 2013 than the cup portion 2011 in the bow portion 2012. When this is applied to the seventh embodiment, a plurality of engagement portions as the subjects to be connected may include the edge portion 2013 per se in the cymbal 2010 or the engagement function portions provided in positions closer to the edge portion 2013 than the cup portion 2011 in the bow portion 2012. It will go well in such a configuration that each of the engagement portions is in a connection relation to at least one of the others of the engagement portions through the damping piece 2030. Modifications satisfying these conditions will be described with reference to FIGS. 13A to 13C and FIGS. 14A to 14K.

Figure 13A:
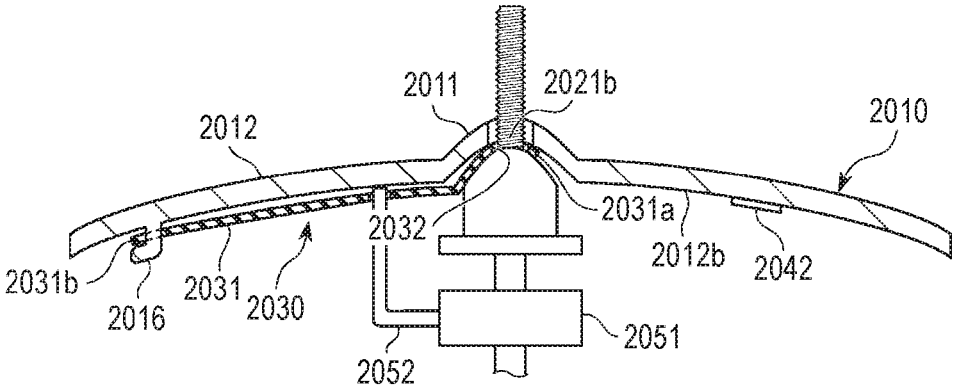
FIGS. 13A to 13C are schematic views of cymbals to which damping pieces according to modifications are applied.
Figure 13B:
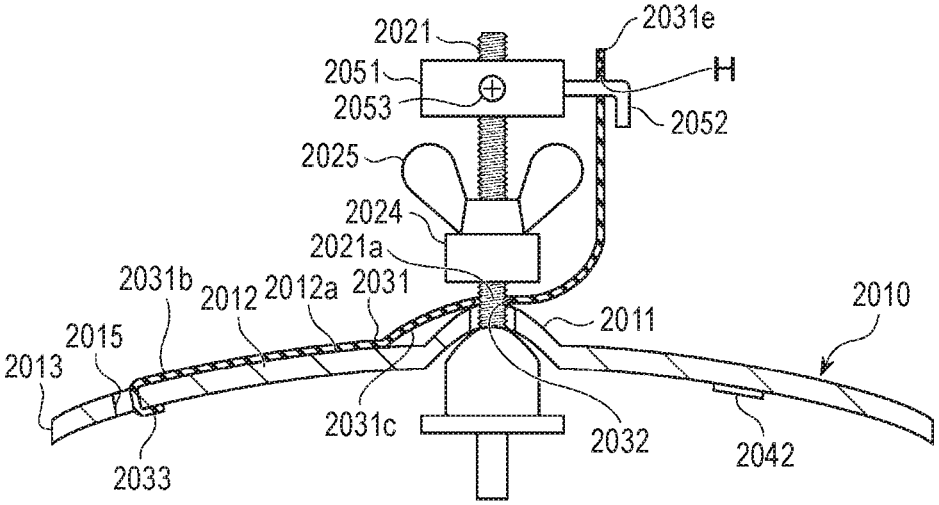
Figure 13C:
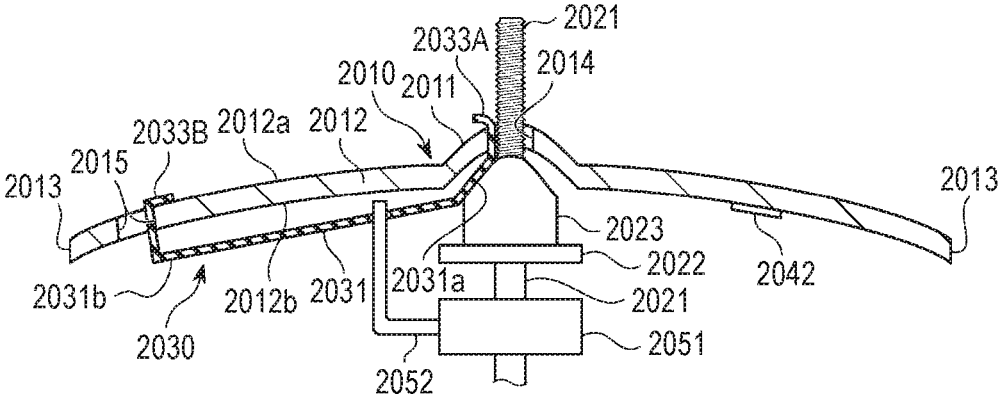

FIGS. 13A, 13B and 13C are schematic sectional views of cymbals to which damping pieces according to modifications are applied. A buffer material 2024, a clamp 2025, etc. are not shown in FIGS. 13A and 13C.

First, an example shown in FIG. 13A can be mainly applied to the fifth embodiment. Thus, a hook 2016 is formed on a back face 2012*b* of a bow portion 2012. The hook 2016 is located in the same position as the engagement hole 2015 (FIG. 9A). The hook 2016 is an example of the "second engagement portion". A rod 2021 is inserted into an attachment hole 2032 in one end portion 2031*a* of the damping piece 2030 so as to be engaged therewith. This point is the same as that in the fifth embodiment. On the other hand, the same attachment hole as the attachment hole 2032 is provided in the other end portion 2031*b* of the damping piece 2030 to be engaged with the hook 2016.

An example shown in FIG. 13B can be mainly applied to the fifth embodiment, but the damping piece 2030 is disposed on not a back side but a front side of the cymbal 2010. The configuration shown in FIG. 11C can be fundamentally used as the configuration of the damping piece 2030. A curved portion 2031*c* convex upward is formed on a side closer to the other end portion 2031*b* than an attachment hole 2032 in a connection portion 2031 of the damping piece 2030. A side closer to one end portion 2031*e* than the attachment hole 2032 of the damping piece 2030 is curved upward to extend. A lock portion H is formed in the one end portion 2031*e* of the damping piece 2030.

The attachment hole 2032 of the damping piece 2030 is engaged with a portion 2021*a* of a rod 2021 on an upper side than a cup portion 2011. The portion 2021*a* is an example of the "first engagement portion". An attachment portion 2033 in the other end portion 2031*b* of the damping piece 2030 is inserted into an engagement hole 2015 from above so as to be engaged therewith. The curved portion 2031*c* is in a non-abutment state with a front face 2012*a* of a bow portion 2012. Incidentally, the connection portion 2031 in at least apart of a region facing the bow portion 2012 has a shape which is not limited to the shape like the curved portion 2031*c* but may be any shape as long as it can be brought into a non-abutment state with the bow portion 2012. In addition, the shape like the curved portion 2031*c* may be provided in the middle of the connection portion 2031 in a radial direction of the cymbal 2010.

A fixation portion 2051 is fixed to the rod 2021 above the clamp 2025. The fixation portion 2051 is fixed detachably, for example, by a screw 2053. A restriction portion 2052 is fixed to the fixation portion 2051. The restriction portion 2052 is inserted into the lock portion H which is formed in the one end portion 2031*e* of the damping piece 2030 so that rotation of the damping piece 2030 can be restricted. Accordingly, a rotation range of the cymbal 2010 can be restricted.

An example shown in FIG. 13C can be mainly applied to the fifth embodiment. The damping piece 2030 preferably has the configuration shown in FIG. 12C. Before the cymbal 2010 is supported on a rod 2021, an attachment portion 2033A in one end portion 2031*a* of the damping piece 2030 is inserted into an insertion hole 2014 from below so as to be engaged therewith and an attachment portion 2033B in the other end portion 2031*b* of the damping piece 2030 is inserted into an engagement hole 2015 from below so as to be engaged therewith. The attachment portion 2033A is an example of the "first engagement portion" and the engagement hole 2015 is an example of the "second engagement portion".

Incidentally, in the example of FIG. 13B or 13C, the attachment portion 2033 or the attachment portion 2033B may be hooked on the edge portion 2013 so as to be engaged therewith as in the example of FIG. 11A. In this case, the edge portion 2013 serves as the "second engagement portion". In addition, in the example shown in FIG. 12A, the damping piece 2030 may be disposed on the front side of the cymbal 2010.

Figure 14A:
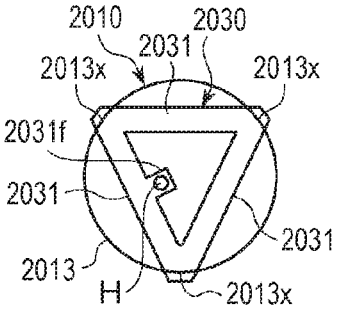
FIGS. 14A to 14K are schematic bottom views of cymbals mounted with damping pieces according to modifications.
Figure 14B:
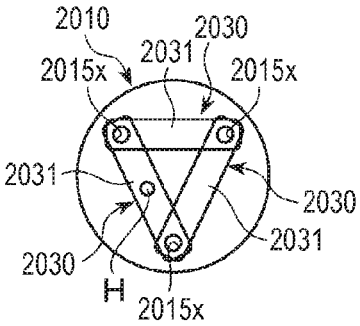
Figure 14C:
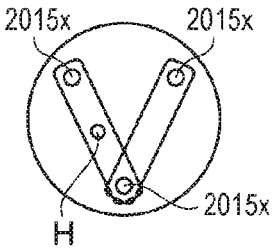
Figure 14D:
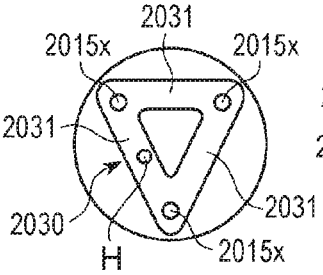
Figure 14E:
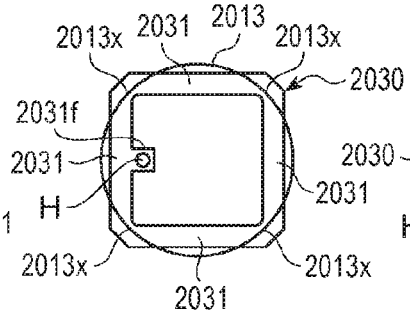
Figure 14F:
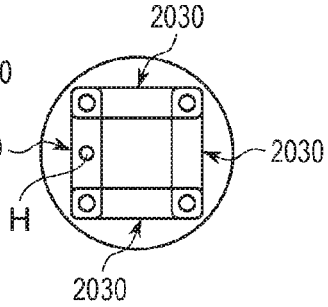
Figure 14G:
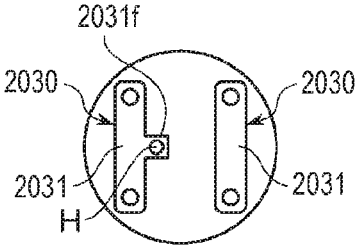
Figure 14H:
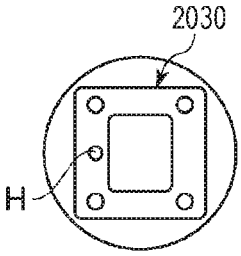
Figure 14I:
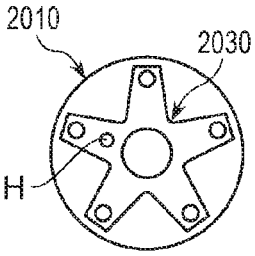
Figure 14J:
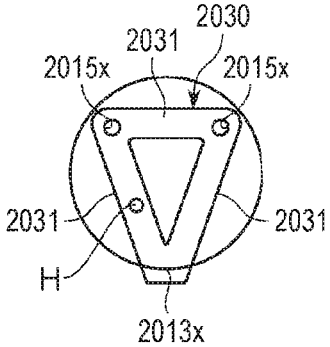

FIGS. 14A to 14K are schematic views of cymbals 10 mounted with damping pieces 2030 according to modifications. In each of FIGS. 14A to 14K, each hole corresponding to an engagement hole 2015 (FIG. 9A etc.) provided in the cymbal 2010 is designated by a white circle. However, the hole may be replaced by a hook 2016 (FIG. 13A). A lock portion H provided in the damping piece 2030 is also designated by a white circle. Of an edge portion 2013, each edge portion 2013*x* is a place with which the damping piece 2030 is engaged. As the shape of a portion engaged with each engagement portion in the damping piece 2030, a hook shape or a hole etc. may be used suitably in accordance with the shape of the engagement portion. The number of the engagement portions as subjects to be connected by the damping piece 2030 or the damping pieces 2030 may be three (FIGS. 14A to 14D and 14J), four (FIGS. 14E to 14H) or five (FIG. 14I), or may be six or more. According to some configurations, the damping piece 2030 alone may connect all three or more engagement portions to one another (FIGS. 14A, 14D, 14E, 14H, 14I and 14J). Alternatively, two or more damping pieces 2030 which connect ones of the engagement portions to each other may be provided (FIGS. 14B, 14C, 14F and 14G). The lock portion H is formed in a proper position of the damping piece 2030. In addition, a protrusive piece 2031*f* may be formed integrally with the damping piece 2030 so that the lock portion H can be formed in the protrusive piece 2031*f* (FIGS. 14A, 14E, and 14G). Although a hitting sensor 2042 is not shown in each of FIGS. 14A to 14K, it is preferable that the hitting sensor 2042 is provided on a back side of the cymbal 2010 in a region where the damping piece 2030 is not exposed on the upper side.

Figure 14K:
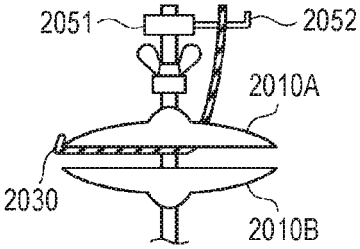

Incidentally, although the damping piece 2030 or the damping pieces 2030 are disposed on the back side of the cymbal 2010 in FIGS. 14A to 14J, the damping piece 2030 or the damping pieces 2030 may be disposed on a front side of the cymbal 2010. In addition, although the examples in each of which the invention is applied to a cymbal have been described above, the invention may be applied to a hi-hat cymbal, as illustrated in FIG. 14K. In this case, for example, mounting of any of the aforementioned damping pieces 2030 is applied to one or each of an upper cymbal 2010A and a lower cymbal 2010B. Incidentally, although there is a case where a solid portion of the damping piece 2030 is interposed between the upper cymbal 2010A and the lower cymbal 2010B, there is no problem if the solid portion of the damping piece 2030 is located partially in a circumferential direction. That is, it is because, during clashing between the two cymbals, the two cymbals can clash with each other properly to generate sound in a place where the solid portion of the damping piece 2030 is absent. In addition, in the example of FIG. 14K, the configuration shown in FIG. 13B can be used as a configuration for engagement between the restriction portion 2052 and the lock portion H above the upper cymbal 2010A.

Incidentally, in the aforementioned examples, the length of the connection portion is set in advance so that a proper urging force or urging forces can be exerted. However, adjustment mechanisms for adjusting the length of the connection portion may be provided as illustrated in FIGS. 15A to 15D.

Figure 15A:
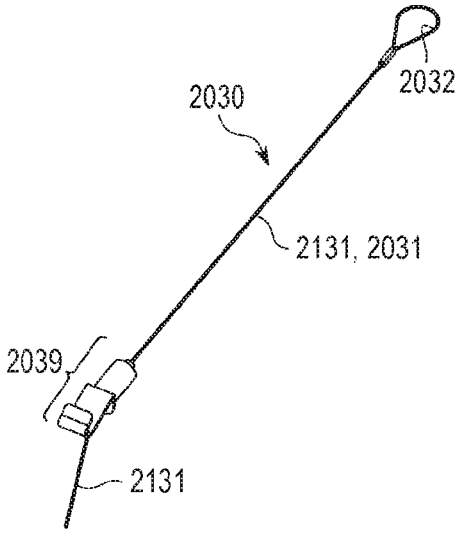
FIG. 15A to 15D are views showing examples of an adjustment mechanism for adjusting a length of a connection portion.
Figure 15B:
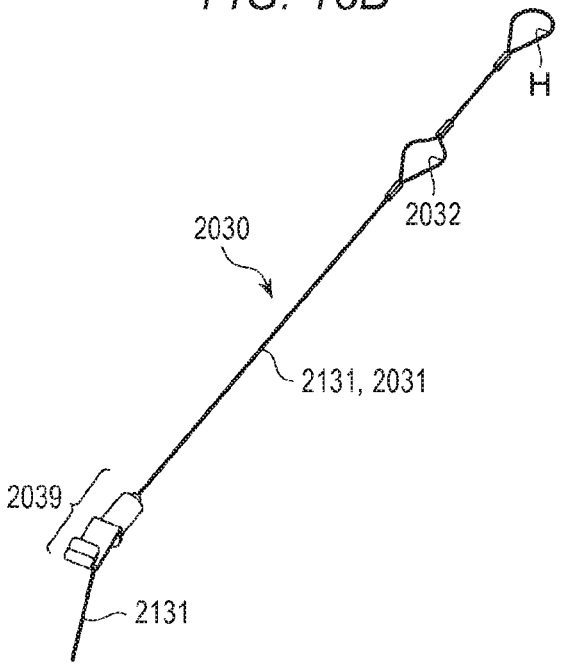
Figure 15C:
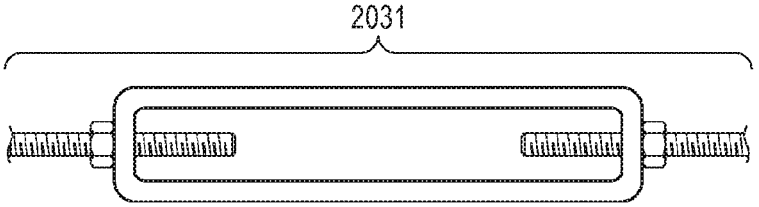
Figure 15D:
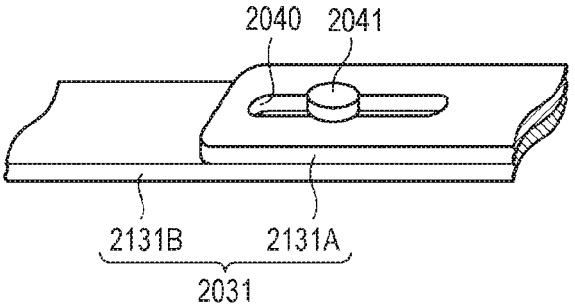

For example, the following configuration may be made as shown in FIG. 15A. That is, a lock mechanism 2039 which can change a lock position relative to a wire 2131 may be provided so that, of the wire 2131, the length corresponding to the connection portion 2031 can be changed stepwise. A configuration in which the angle of the lock mechanism 2039 is changed to lock or release the wire 2131 may be conceived regardless of the configuration of the lock mechanism 2039. A length adjustment mechanism which can adjust the length continuously may be used. Incidentally, when the configuration in FIG. 15A is applied to the sixth embodiment (FIG. 11A), a lock portion H may be provided at a front end of a portion extending from an attachment hole 2032, as shown in FIG. 15B. In addition, as shown in FIG. 15C, a turnbuckle mechanism may be used for the connection portion 2031. A turnbuckle of any form such as a split frame form or a pipe form may be used. Alternatively, the following configuration may be made as shown in FIG. 15D. That is, the connection portion 2031 is constituted by two plate members 2131A and 2131B and the plate member 2131A is coupled to the plate member 2131B by a bolt 2041 through a long hole 2040 provided in the plate member 2131A. The entire length of the connection portion 2031 can be adjusted by a fastening position of the bolt 2041 relative to the long hole 2040. With such an adjustment mechanism, the degree of damping can be adjusted. In addition, the damping piece 2030 may be made of inelastic metal alone etc. For example, with the configuration in FIG. 15A or 15B, the length of the connection portion 2031 can be easily adjusted manually after opposite end portions of the damping piece 2030 are engaged with engagement portions as subjects to be engaged. Accordingly, it is possible to give suitable tension to the cymbal 2010 even by the damping piece 2030 made of metal.

Figure 15E:
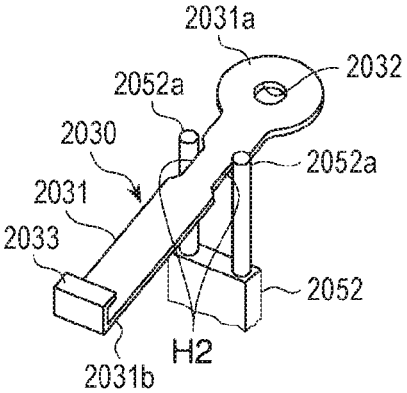
FIG. 15E is a perspective view showing combination of a damping piece and a restriction portion according to a modification.

In each of the aforementioned embodiments, the restriction portion 2052 which is a stick and the lock portion H which is a hole are used in combination. However, combination of the both is not limited to any of the illustrated ones as long as the restriction portion 2052 is engaged with the damping piece 2030 to restrict its rotational displacement. For example, according to one configuration, as shown in FIG. 15E, a restriction portion 2052 may be disposed in a form in which the damping piece 2030 is held from two sides in the rotation direction of the cymbal 2010. For example, the damping piece 2030 shown in FIG. 9C may be modified so that lock portions H2 as notched portions can be formed in the connection portion 2031. On the other hand, a pair of two stick-shaped portions 2052*a* are formed protrusively in the restriction portion 2052. The restriction portion 2052 is disposed so that the lock portions H2 can be located between the pair of stick-shaped portions 2052*a*. The lock portions H2 may be held between the stick-shape portions 2052*a* with slight margins. Such a configuration can be applied to modifications in the aforementioned embodiments.

Eighth Embodiment

In the configuration which has been described above, the damping piece 2030 is disposed on either the front side or the back side of the cymbal 2010. However, the damping piece 2030 may be disposed separately on each of the front side and the back side of the cymbal 2010. In addition, an integrated damping piece 2030 which is disposed on a front side and aback side of a cymbal 2010 may be used as will be described as an eighth embodiment.

Figure 16A:
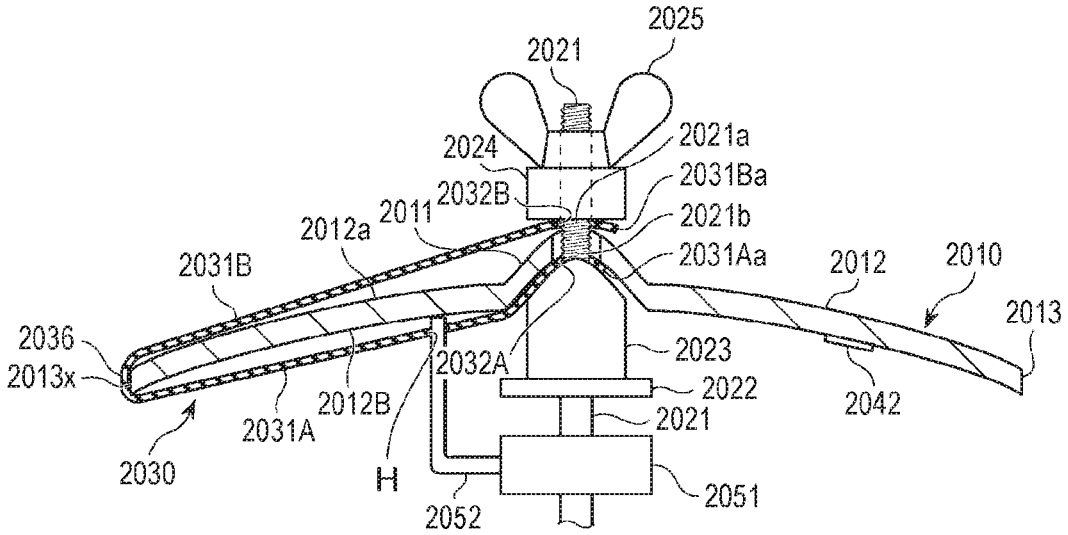
FIG. 16A is a schematic sectional view of a cymbal type percussion instrument according to an eighth embodiment and FIG. 16B is a perspective view of a damping piece.
Figure 16B:
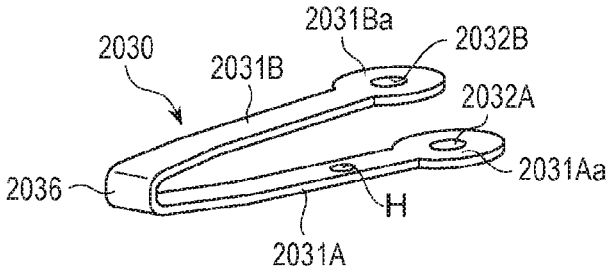

FIG. 16A is a schematic sectional view of a cymbal type percussion instrument according to the eighth embodiment. FIG. 16B is a perspective view of the damping piece 2030.

As shown in FIG. 16B, the damping piece 2030 has an upper connection portion 2031B and a lower connection portion 2031A, which serve as a connection portion 2031. An attachment hole 2032A is formed in an end portion 2031Aa of the lower connection portion 2031A which also serves as one end portion of the connection portion 2031, and an attachment hole 2032B is formed in an end portion 2031Ba of the upper connection portion 2031B which also serves as the other end portion of the connection portion 2031. The upper connection portion 2031B and the lower connection portion 2031A are coupled to each other through a coupling portion 2036. Incidentally, it is not necessary to give a bending habit to the connection portion 2031 in the coupling portion 2036 in advance. A range of from the end portion 2031Aa to the end portion 2031Ba through the coupling portion 2036 may be flat in a free state.

A lock portion H to which a restriction portion 2052 can be locked is formed in the lower connection portion 2031A. The lock portion H is formed between the attachment hole 2032A and the coupling portion 2036. Configuration of a fixation portion 2051 and configuration of the restriction portion 2052 are the same as those in the fifth embodiment. An upper end of the restriction portion 2052 is inserted into the lock portion H so that rotation of the damping piece 2030 can be restricted. Accordingly, a rotation range of the cymbal 2010 can be restricted. It is desirable that the damping piece 2030 is mounted so that the damping piece 2030 can be positioned in a region on an opposite side to a location side of a hitting sensor 2042 across a rod 2021.

As shown in FIG. 16A, a portion of the rod 2021 on an upper side of a cup portion 2011 is fastened by a clamp 2025 through a buffer material 2024. The attachment hole 2032A is engaged with a portion 2021*b* (lower engagement portion) interposed between the cup portion 2011 and a buffer material 2023. The attachment hole 2032B is engaged with a portion 2021*a* (upper engagement portion) of the rod 2021 interposed between the cup portion 2011 and the buffer material 2024.

In the configuration, in order to support the cymbal 2010 on the rod 2021, first, the rod 2021 is inserted into the attachment hole 2032A from below so that the end portion 2031Aa of the lower connection portion 2031A can be interposed between the cup portion 2011 and the buffer material 2023. Next, the coupling portion 2036 is put around an edge portion 2013*x* and the rod 2021 is inserted into the attachment hole 2032B so that the end portion 2031Ba of the upper connection portion 2031B can be interposed between the cup portion 2011 and the buffer material 2024. Then, the end portion 2031Ba and the buffer material 2024 are fastened by the clamp 2025 from the upper side of the cup portion 2011.

A length of the connection portion 2031 (a length between the attachment holes 2032A and 2032B) is slightly shorter than a distance between the portion 2021*b* and the portion 2021*a* through the edge portion 2013*x*. Thus, the lower connection portion 2031A and the upper connection portion 2031B are brought into a tensile state respectively. Due to elasticity of the lower connection portion 2031A and the upper connection portion 2031B, the edge portion 2013*x* is urged in a direction toward a place where the portions 2021*a* and 2021*b* are located, i.e. toward the radial center of the cymbal 2010. When considered in contrast with the fifth embodiment, the portions 2021*b* and 2021*a* correspond to the "first engagement portions" respectively, and the edge portion 2013*x* corresponds to the "second engagement portion".

Incidentally, the shape of a curved portion corresponding to the curved portion 2031*c* (FIG. 13B) in the middle of the upper connection portion 2031B in the radial direction of the cymbal 2010 may be used.

According to the embodiment, it is possible to restricting a rotation range without applying special treatment etc. to the cymbal so that it is possible to increase detection accuracy of hitting. At the same time, it is possible to obtain the same effect as that in the fifth embodiment in order to prevent the damping piece 2030 from becoming an obstacle to hitting.

According to the embodiment, it is possible to obtain the same effect as that in the fifth embodiment in order to reduce volume without excessively affecting hitting sound. Particularly, the cymbal 2010 does not have to have any engagement hole for mounting the damping piece 2030. Accordingly, versatility of the damping piece 2030 is also wide. In addition, since the configuration of the damping piece 2030 is simple, the manufacturing cost can be reduced. In addition, since sound can be damped from the opposite front and back sides, a sound damping effect is high.

In addition, although the embodiment has been described in the case where the mounting member is used as the damping piece, the mounting member may be used for changing the tone like a general mute. For example, the magnitude of tension and a contact area of the mounting member may be set desirably to change the tone. Variations may be prepared in advance as to the magnitude of the tension and the contact area of the mounting member so that a desired variation can be selected from the variations and used.

Incidentally, in the configuration of FIGS. 16A and 16B, a hook-like attachment portion 2033A (FIG. 13C) may be used in one or each of the end portion 2031Aa of the lower connection portion 2031A and the end portion 2031Ba of the upper connection portion 2031B in place of the attachment holes 2032A and 2032B.

Also in the embodiment, the configuration illustrated in FIG. 13B can be used as a configuration for engagement between the restriction portion 2052 and the lock portion H above the cymbal 2010.

Incidentally, in each of the aforementioned embodiments, when an effect is mainly demanded for increasing the detection accuracy of hitting without requiring the damping effect of the cymbal and for preventing the mounting member from becoming an obstacle to hitting, the mounting member engaged with the restriction portion 2052 does not have to be the damping piece 2030. For example, the mounting member may be a member mounted fixedly on the cymbal 2010 like an accessory etc.

Although the invention has been described as a device for restricting the rotation range, the rotation direction is not limited but the device may serve for restricting rotation (i.e. revolution) when the cymbal can revolve in both directions around the rod.

Although the invention has been described above in detail based on its preferred embodiments, the invention is not limited to the specific embodiments. Various modes without departing from the gist of the invention may be also contained in the invention. Parts of the aforementioned embodiments or the aforementioned modifications may be combined suitably.

What is claimed is:

1. A mounting device for a cymbal type percussion instrument, the cymbal type percussion instrument including at least one cymbal supported on a support, the mounting device comprising:

a mounting member which is mounted in at least two different positions on the cymbal type percussion instrument, the mounting member which is configured to suppress motion of the cymbal when the mounting member is mounted in the at least two different positions on the cymbal type percussion instrument so as to hold a position of the mounting member relative to the cymbal, the mounting member which includes a connection portion which connects a first engagement portion and a second engagement portion to each other, wherein, when the first engagement portion and the second engagement portion are connected to each other, the connection portion urges the first engagement portion and the second engagement portion in a direction to approach each other, and at least a part of the connection portion, which faces a bow portion of the cymbal, is brought into a non-abutment state with the bow portion, wherein the connection portion includes an adjustment mechanism which adjusts a length of the connection portion.

2. The mounting device according to claim 1, wherein the cymbal includes a cup portion and the bow portion, an insertion hole formed in the cup portion, a rod which is a part of the support inserted into the insertion hole to support the cup portion on the support, the bow portion coupled to the cup portion and having an edge portion as an outer circumferential edge, and the first engagement portion is one of the insertion hole, the support and a portion fixed to the support, and the second engagement portion is one of the edge portion of the bow portion and an engagement function portion provided in a position closer to the edge portion than the cup portion in the bow portion.

3. A damping device which is the mounting device according to claim 2, and which is configured to reduce hitting sound of the cymbal by suppressing vibrating motion of the cymbal when the cymbal is hit.

4. The damping device according to claim 3, wherein the connection portion is constituted by an elastic member and exerts an urging force due to its elasticity.

5. The damping device according to claim 2, wherein the connection portion is constituted by an elastic member and exerts an urging force due to its elasticity.

6. A cymbal type percussion instrument which includes the mounting device according to claim 2, the cymbal which is an acoustic cymbal which is hit to make vibration to thereby produce sound as performance sound, the cymbal type percussion instrument comprising:

a sensor which is attached to the acoustic cymbal and which is configured to detect the vibration of the acoustic cymbal;

a fixation portion which is fixed to the support; and a restriction portion which is a part of the fixation portion or fixed to the fixation portion, and which is engaged with the mounting member mounted on the acoustic cymbal to thereby restrict the acoustic cymbal from rotating, wherein the mounting device is configured to suppress rotating motion of the acoustic cymbal when the acoustic cymbal is hit.

7. The cymbal type percussion instrument according to claim 6, wherein the mounting member is a damping member which is configured to reduce hitting sound of the acoustic cymbal.

8. A cymbal type percussion instrument which includes the mounting device according to claim 1, wherein the cymbal is an acoustic cymbal, the mounting member is a damping member which is mounted on the acoustic cymbal so that at least a part of the damping member is exposed on an upper side from the acoustic cymbal and which is configured to reduce hitting sound of the acoustic cymbal, and the cymbal type percussion instrument includes a fixation portion which is fixed to the support, and a restriction portion which is a part of the fixation portion or fixed to the fixation portion and which is engaged with the damping member mounted on the acoustic cymbal to thereby restrict the acoustic cymbal from rotating.

9. The cymbal type percussion instrument according claim 8, further comprising:

a sensor which is attached to the acoustic cymbal and which is configured to detect vibration of the acoustic cymbal.

10. A cymbal type percussion instrument which includes the mounting device according to claim 1, wherein the cymbal is an acoustic cymbal, the mounting member is a damping member which is mounted on the acoustic cymbal so that at least a part of the damping member is exposed on an upper side from the acoustic cymbal and which is configured to reduce hitting sound of the acoustic cymbal, the cymbal type percussion instrument includes a fixation portion which is fixed to the support, and a restriction portion which is a part of the fixation portion or fixed to the fixation portion and which is engaged with the damping member mounted on the acoustic cymbal to thereby restrict the acoustic cymbal from rotating.

11. The cymbal type percussion instrument according to claim 10, further comprising:

a sensor which is attached to the acoustic cymbal and which is configured to detect vibration of the acoustic cymbal.

12. A cymbal rotation restricting device which is the mounting device according to claim 2, the cymbal which is an acoustic cymbal, the cymbal rotation restricting device comprising:

a restriction portion which is a part of a fixation portion fixed to the support or fixed to the fixation portion, and which is engaged with the mounting member mounted on the acoustic cymbal to thereby restrict the acoustic cymbal from rotating.

13. The mounting device according to claim 1, wherein the connection portion includes a first portion configured to engage with the first engagement portion and a second portion configured to engage with the second engagement portion, and a first length between the first portion of the connection portion and the second portion of the connection portion in an unconnected state in which the connection portion is not connecting the first engagement portion and the second engagement portion to each other is less than a second length between the first portion of the connection portion and the second portion of the connection portion in a connected state in which the connection portion connects the first engagement portion and the second engagement portion to each other.

* * * * *